US010679487B1

(12) United States Patent
Farivar et al.

(10) Patent No.: US 10,679,487 B1
(45) Date of Patent: Jun. 9, 2020

(54) UTILIZING SENSOR DATA TO IDENTIFY AN ITEM LEFT IN A VEHICLE AND TO PERFORM ACTIONS BASED ON IDENTIFYING THE LEFT ITEM

(71) Applicant: Capital One Services, LLC, McLean, VA (US)

(72) Inventors: Reza Farivar, Champaign, IL (US); Austin Walters, Savoy, IL (US); Galen Rafferty, Mahomet, IL (US)

(73) Assignee: Capital One Services, LLC, McLean, VA (US)

( * ) Notice: Subject to any disclaimer, the term of this patent is extended or adjusted under 35 U.S.C. 154(b) by 0 days.

(21) Appl. No.: 16/778,992

(22) Filed: Jan. 31, 2020

(51) Int. Cl.
*G08B 21/24* (2006.01)
*G06Q 50/30* (2012.01)

(52) U.S. Cl.
CPC ..... *G08B 21/24* (2013.01); *G06Q 50/30* (2013.01); *G07C 2209/63* (2013.01)

(58) Field of Classification Search
CPC ..... G08B 21/24; G06Q 50/30; G07C 2209/63
See application file for complete search history.

(56) References Cited

U.S. PATENT DOCUMENTS 9,720,416 B1 * 8/2017 Rao ..... G01C 21/3461
10,127,795 B1 * 11/2018 Hwang ..... H04W 4/023
10,303,961 B1 * 5/2019 Stoffel ..... B60Q 3/76
2016/0379466 A1 * 12/2016 Payant ..... G08B 21/24 340/457
2018/0068544 A1 * 3/2018 Caperell ..... G08B 21/0275
2018/0224849 A1 * 8/2018 Gordon ..... G08B 21/24
2018/0308191 A1 * 10/2018 Matthiesen ..... G06Q 50/30
2018/0342141 A1 * 11/2018 Baker ..... B60N 2/2812
2020/0058210 A1 * 2/2020 Williams ..... H04W 4/06
2020/0066136 A1 * 2/2020 Le ..... G08B 25/08

OTHER PUBLICATIONS

Dave Baldwin, "8 Life-Saving Car Seat Alarms That Remind Parents There's a Baby in the Back Seat", May 13, 2018, 11 pages.

* cited by examiner

*Primary Examiner* — Ryan W Sherwin
(74) *Attorney, Agent, or Firm* — Harrity & Harrity, LLP

(57) ABSTRACT

A device receives, at a first time, first sensor data from a sensor associated with a vehicle, wherein a passenger and an item are located within the vehicle after the first time, and determines a first weight based on the first sensor data. The device receives, at a second time, second sensor data from the sensor, wherein the passenger is not located within the vehicle at the second time, and determines a second weight based on the second sensor data. The determines whether the item is located in the vehicle at the second time based on the first weight and the second weight, and selectively performs actions based on determining whether the item is located in the vehicle. The actions are performed after the item is determined to be located in the vehicle, and are not performed after the item is not determined to be located in the vehicle.

20 Claims, 14 Drawing Sheets

UTILIZING SENSOR DATA TO IDENTIFY AN ITEM LEFT IN A VEHICLE AND TO PERFORM ACTIONS BASED ON IDENTIFYING THE LEFT ITEM

BACKGROUND

A transportation service may include a ride share service that matches passengers with drivers and/or vehicles via websites and/or mobile applications, a taxicab service, a rental car service, a train service, a subway service, a bus service, an airplane service, and/or the like.

SUMMARY

According to some implementations, a method may include receiving, at a first time, first sensor data from a sensor associated with a vehicle, wherein a passenger is located within the vehicle after the first time, and wherein an item associated with the passenger is located within the vehicle after the first time. The method may include determining a first weight based on the first sensor data, and receiving, at a second time, second sensor data from the sensor associated with the vehicle, wherein the second time occurs after the first time, and wherein the passenger is not located within the vehicle at the second time. The method may include determining a second weight based on the second sensor data, and comparing the first weight and the second weight to determine whether the item is located in the vehicle at the second time, wherein the item is determined to be located in the vehicle at the second time when a difference between the first weight and the second weight satisfies a threshold value, and wherein the item is not determined to be located in the vehicle at the second time when a difference between the first weight and the second weight fails to satisfy the threshold value. The method may include selectively performing one or more actions based on determining whether the item is located in the vehicle at the second time, wherein the one or more actions are performed after the item is determined to be located in the vehicle at the second time, and wherein the one or more actions are not performed after the item is not determined to be located in the vehicle at the second time.

According to some implementations, a device may include one or more memories, and one or more processors, communicatively coupled to the one or more memories, to receive, at a first time, first sensor data from a sensor associated with a vehicle, wherein a passenger is located within the vehicle after the first time, and wherein an item associated with the passenger is located within the vehicle after the first time. The one or more processors may determine a first weight based on the first sensor data, and may receive, at a second time, second sensor data from the sensor associated with the vehicle, wherein the second time occurs after the first time, and wherein the passenger is not located within the vehicle at the second time. The one or more processors may determine a second weight based on the second sensor data, and may compare the first weight and the second weight to determine that the item is located in the vehicle at the second time, wherein the item is determined to be located in the vehicle at the second time when a difference between the first weight and the second weight satisfies a threshold value. The one or more processors may perform one or more actions based on determining that the item is located in the vehicle at the second time, wherein the one or more actions include one or more of: providing, to a user device of the passenger, a message or an automated telephone call indicating that the passenger left the item in the vehicle, or providing, to a user device of a driver of the vehicle, the message or the automated telephone call indicating that the passenger left the item in the vehicle.

According to some implementations, a non-transitory computer-readable medium may store one or more instructions that, when executed by one or more processors of a device, may cause the one or more processors to receive, at a first time, first sensor data from a sensor associated with a vehicle, wherein a passenger is located within the vehicle after the first time, and wherein an item associated with the passenger is located within the vehicle after the first time. The one or more instructions may cause the one or more processors to determine a first weight based on the first sensor data, and receive, at a second time, second sensor data from the sensor associated with the vehicle, wherein the second time occurs after the first time, and wherein the passenger is not located within the vehicle at the second time. The one or more instructions may cause the one or more processors to determine a second weight based on the second sensor data, and compare the first weight and the second weight to determine whether the item is located in the vehicle at the second time, wherein the item is determined to be located in the vehicle at the second time when a difference between the first weight and the second weight satisfies a threshold value, and wherein the item is not determined to be located in the vehicle at the second time when a difference between the first weight and the second weight fails to satisfy the threshold value. The one or more instructions may cause the one or more processors to selectively perform a first action or a second action based on determining whether the item is located in the vehicle at the second time, wherein the first action is performed after the item is determined to be located in the vehicle at the second time, and wherein the second action is performed after the item is not determined to be located in the vehicle at the second time.

DETAILED DESCRIPTION

Figure 1A:
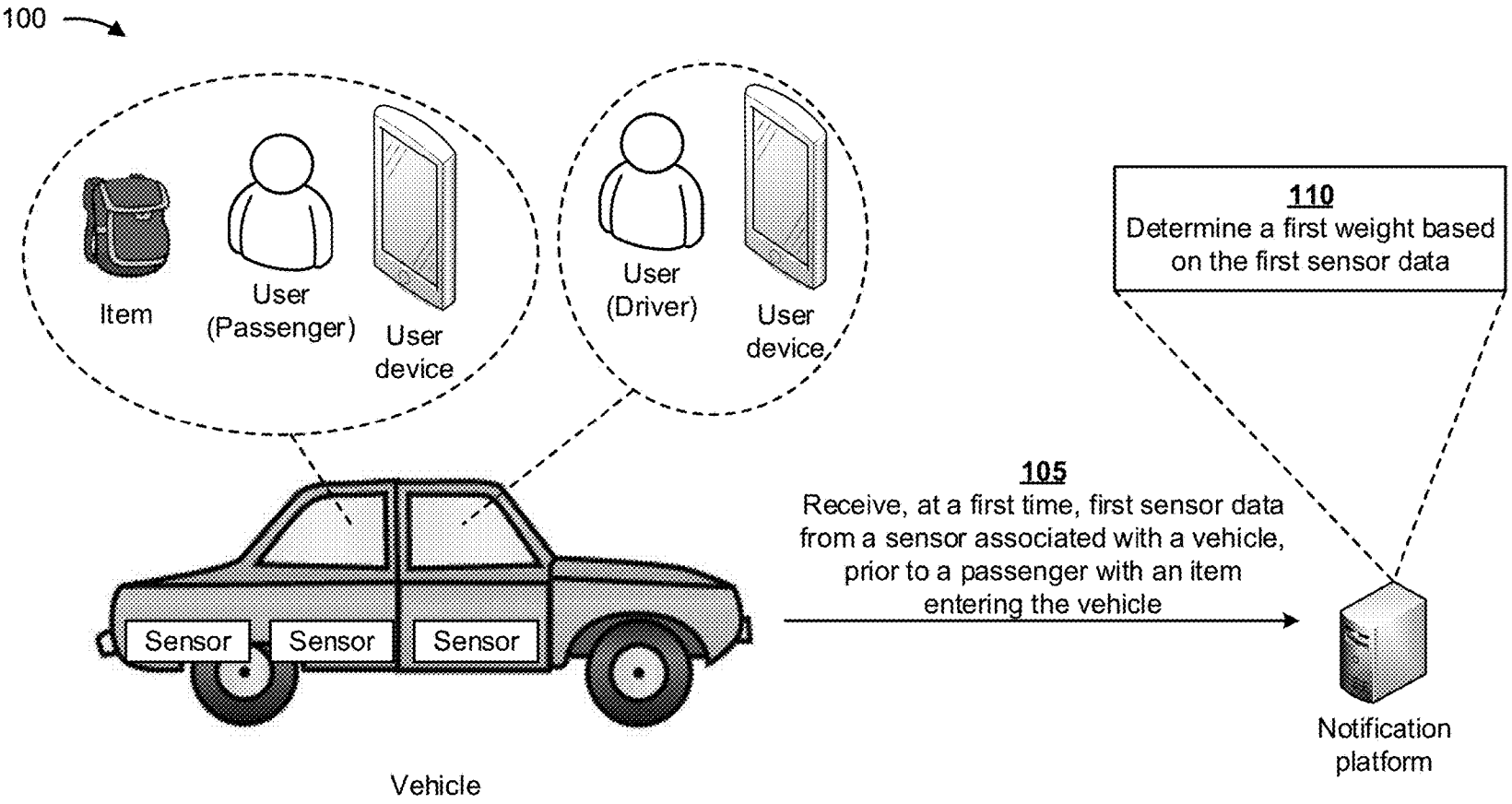
FIGS. 1A-1I are diagrams of one or more example implementations described herein.

The following detailed description of example implementations refers to the accompanying drawings. The same reference numbers in different drawings may identify the same or similar elements.

Many times, passengers in vehicles, such as taxicabs and/or ride shares, leave items in the vehicles. Such items may never be recovered by the passengers. The items may be recovered by the passengers based on contacting a taxicab or ride share service, identifying the lost items, and traveling to retrieve the lost items from the taxicab or ride share service (or arranging to have the lost items delivered). This causes a waste of computing resources (e.g., processing resources, memory resources, and/or the like), network resources, and/or the like associated with contacting the taxicab or ride share service and identifying the lost items; a waste of transportation resources associated with traveling to retrieve the lost items or having the lost items delivered; a waste of computing resources, network resources, and/or the like associated with purchasing replacement items for the lost items; and/or the like. Furthermore, if the lost items are of significant weight (e.g., luggage, packages, and/or the like), the lost items will unnecessarily contribute to increased fuel consumption (e.g., poor gas mileage) of the vehicles.

Some implementations described herein provide a notification platform that utilizes sensor data to identify an item left in a vehicle and to perform actions based on identifying the left item. For example, the notification platform may receive, at a first time, first sensor data from a sensor associated with a vehicle, wherein a passenger is located within the vehicle after the first time, and wherein an item associated with the passenger is located within the vehicle after the first time. The notification platform may determine a first weight based on the first sensor data, and may receive, at a second time, second sensor data from the sensor associated with the vehicle, wherein the second time occurs after the first time, and wherein the passenger is not located within the vehicle at the second time. The notification platform may determine a second weight based on the second sensor data, and may compare the first weight and the second weight to determine that the item is located in the vehicle at the second time, wherein the item is determined to be located in the vehicle at the second time when a difference between the first weight and the second weight satisfies a threshold value. The notification platform may perform one or more actions based on determining that the item is located in the vehicle at the second time, wherein the one or more actions may include one or more of providing, to a user device of the passenger, a message or an automated telephone call indicating that the passenger left the item in the vehicle, or providing, to a user device of a driver of the vehicle, the message or the automated telephone call indicating that the passenger left the item in the vehicle.

In this way, the notification platform reduces a quantity of lost items in vehicles, which reduces a waste of resources (e.g., processing resources, memory resources, network resources, transportation resources, and/or the like) associated with retrieving the lost items in the vehicles, replacing the lost items, and/or the like. Furthermore, the vehicles will not experience increased fuel consumption (e.g., wasted natural resources) associated with transporting lost items of significant weight.

Although implementations are described in connection with a ride share service and/or a taxicab service, the implementations described herein may be utilized with any transportation service, such as a rental car service, a train service, a subway service, a bus service, an airplane service, and/or the like.

FIGS. 1A-1I are diagrams of one or more example implementations 100 described herein. As shown in FIG. 1A, a vehicle may transport a driver associated with a user device and a passenger associated with a user device. The vehicle may include a taxicab associated with a taxicab service, a ride share vehicle associated with ride share service, and/or the like. The passenger may bring an item (e.g., the user device, a laptop computer, luggage, a back pack, and/or the like) in the vehicle. As further shown, the vehicle may include one or more sensors provided at one or more locations of the vehicle (e.g., one or more sensors provided at a passenger seat of the vehicle). The one or more sensors may include a piezoelectric weight sensor, a Hall effect weight sensor, a strain gauge weight sensor, and/or the like located under a trunk plate of the vehicle, under one or more seats of the vehicle, under one or more floor panels of the vehicle, and/or the like; a camera located within the vehicle; a radar sensor located within the vehicle; a sound sensor located within the vehicle; a motion sensor located within the vehicle; and/or the like. In some implementations, the user devices and the vehicle may be associated with a notification platform. In some implementations, the one or more sensors may communicate with the user device of the driver, a vehicle control system of the vehicle, the user device of the passenger, the notification platform, and/or the like.

As further shown in FIG. 1A, and by reference number 105, the notification platform may receive, at a first time prior to the passenger with the item entering the vehicle, first sensor data from a sensor associated with the vehicle, from the vehicle control system of the vehicle, from the user device associated with a driver of the vehicle, and/or the like. For example, a sensor may generate the first sensor data prior to the passenger with the item entering the vehicle. In some implementations, the sensor may include a weight sensor provided under a seat of the vehicle to be occupied by the passenger and the item. The weight sensor may determine a first weight, and may provide, to the notification platform, data indicating the first weight (e.g., the first sensor data). In some implementations, when the item is to be provided in a trunk of the vehicle, the sensor may include a first weight sensor provided under the seat of the vehicle to be occupied by the passenger and a second weight sensor provided under a trunk plate of the vehicle. In such implementations, the first weight sensor may determine a first weight and the second weight sensor may determine a second weight. The first weight sensor may provide data indicating the first weight to the notification platform, and the second weight sensor may provide data indicating the second weight to the notification platform.

As further shown in FIG. 1A, and by reference number 110, the notification platform may determine a first weight based on the first sensor data. For example, the notification platform may determine that a weight of the seat of the vehicle to be occupied by the passenger as the first weight. In some implementations, the notification platform may add the weight of the seat, provided by the first weight sensor, to a weight of the trunk plate of the vehicle, provided by the second weight sensor, in order to generate the first weight. In some implementations, the first weight may include a weight of the driver of the vehicle if the first sensor data includes data indicating the weight of the driver. In some implementations, when the first weight increases due to the passenger entering the vehicle, the first weight may provide an indication that the passenger is traveling in the vehicle.

Figure 1B:
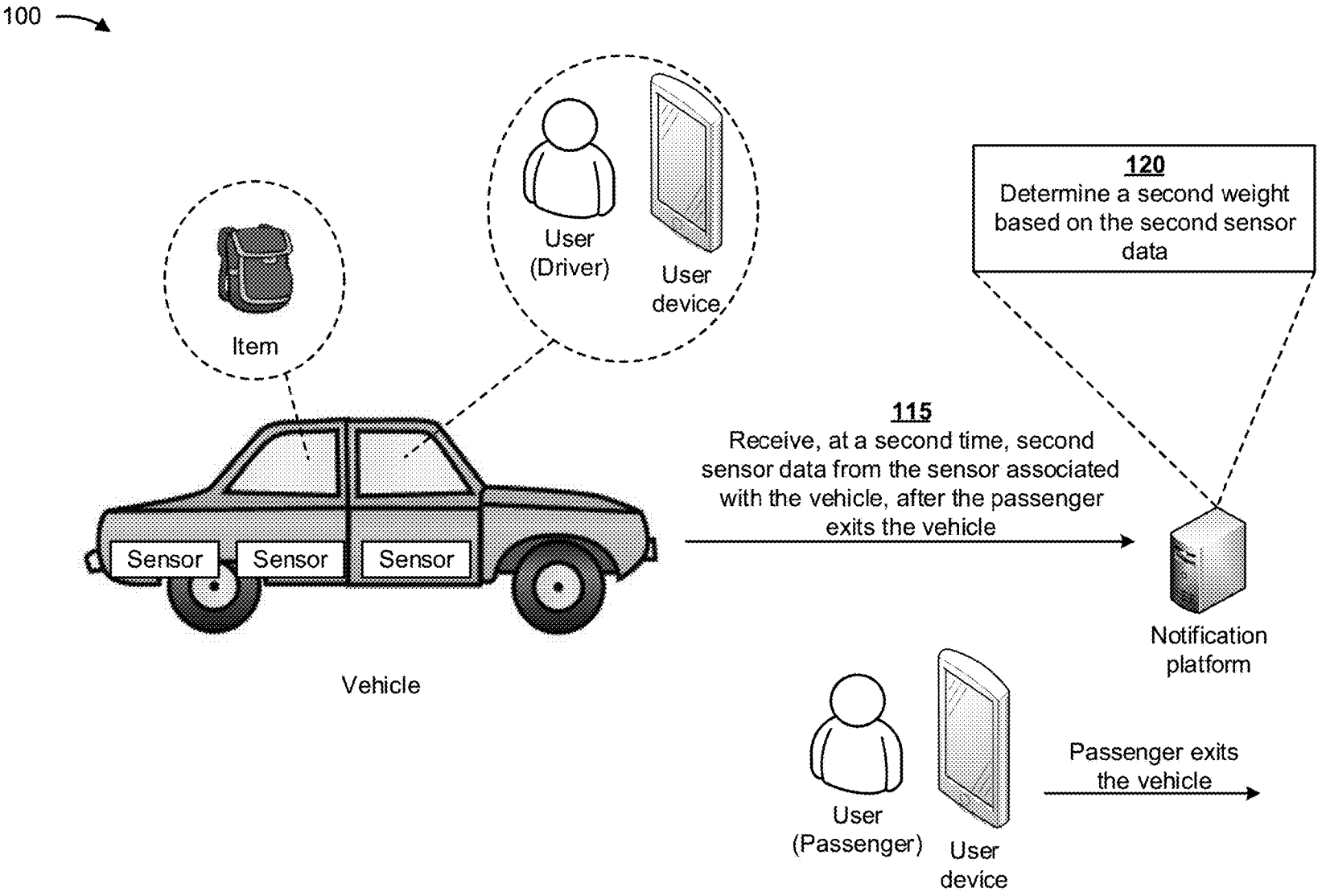

As shown in FIG. 1B, at a second time, which occurs after the first time, the passenger may exit the vehicle but may leave the item in the vehicle. As further shown in FIG. 1B, and by reference number 115, the notification platform may receive, at the second time, second sensor data from the sensor associated with the vehicle, from the vehicle control system of the vehicle, from the user device associated with the driver of the vehicle, and/or the like. For example, the sensor associated with the passenger and the item may generate the second sensor data when the passenger exits the vehicle. In some implementations, the sensor may be triggered to generate the second sensor data when the passenger exits the vehicle based on detecting a weight change of a threshold amount (e.g., more than 50 kilograms), based on the passenger ending a ride share service, based on the driver ending a transportation service, and/or the like. For example, the sensor may repeatedly determine the first sensor data and may determine when that first sensor data changes by more than the threshold amount, which triggers generation of the second sensor data. In some implementations, the sensor may include a weight sensor provided under a seat of the vehicle occupied by the item (e.g., since the passenger exited the vehicle). The weight sensor may determine a weight (e.g., the weight of the item), and may provide, to the notification platform, data indicating the weight (e.g., the second sensor data). In some implementations, when the item is provided in the trunk of the vehicle, the sensor may include the first weight sensor provided under the seat of the vehicle previously occupied by the passenger and the second weight sensor provided under the trunk plate of the vehicle. In such implementations, the first weight sensor may not determine the weight of the passenger (e.g., since the passenger exited the vehicle) and the second weight sensor may determine the weight of the item. The first weight sensor may provide data indicating a weight of the seat of the vehicle to the notification platform, and the second weight sensor may provide data indicating the weight of the item to the notification platform.

As further shown in FIG. 1B, and by reference number 120, the notification platform may determine a second weight based on the second sensor data. For example, the notification platform may determine the weight of the item to be the second weight. In some implementations, the notification platform may determine the weight of the item, provided by the second weight sensor, to be the second weight. In such implementations, a difference between the first weight and the second weight may provide an indication of the weight of item left behind in the vehicle. In some implementations, the second weight may include the weight of the driver of the vehicle if the second sensor data includes data indicating the weight of the driver. In some implementations, the second weight may be substantially equivalent to the first weight when the passenger exits the vehicle with the item (e.g., does not leave the item in the vehicle). In such implementations, a difference between the first weight and the second weight may be substantially equal to zero.

Although FIGS. 1A and 1B show specific quantities of user devices, vehicles, and/or the like, in some implementations, the notification platform may be associated with more user devices, vehicles, and/or the like than depicted in FIGS. 1A and 1B. For example, the notification platform may be associated with hundreds, thousands, or more user devices, vehicles, and/or the like that generate thousands, millions, billions, or more data points. In this way, the notification platform may handle thousands, millions, billions, etc., of data points within a time period, and thus may provide "big data" capability.

Figure 1C:
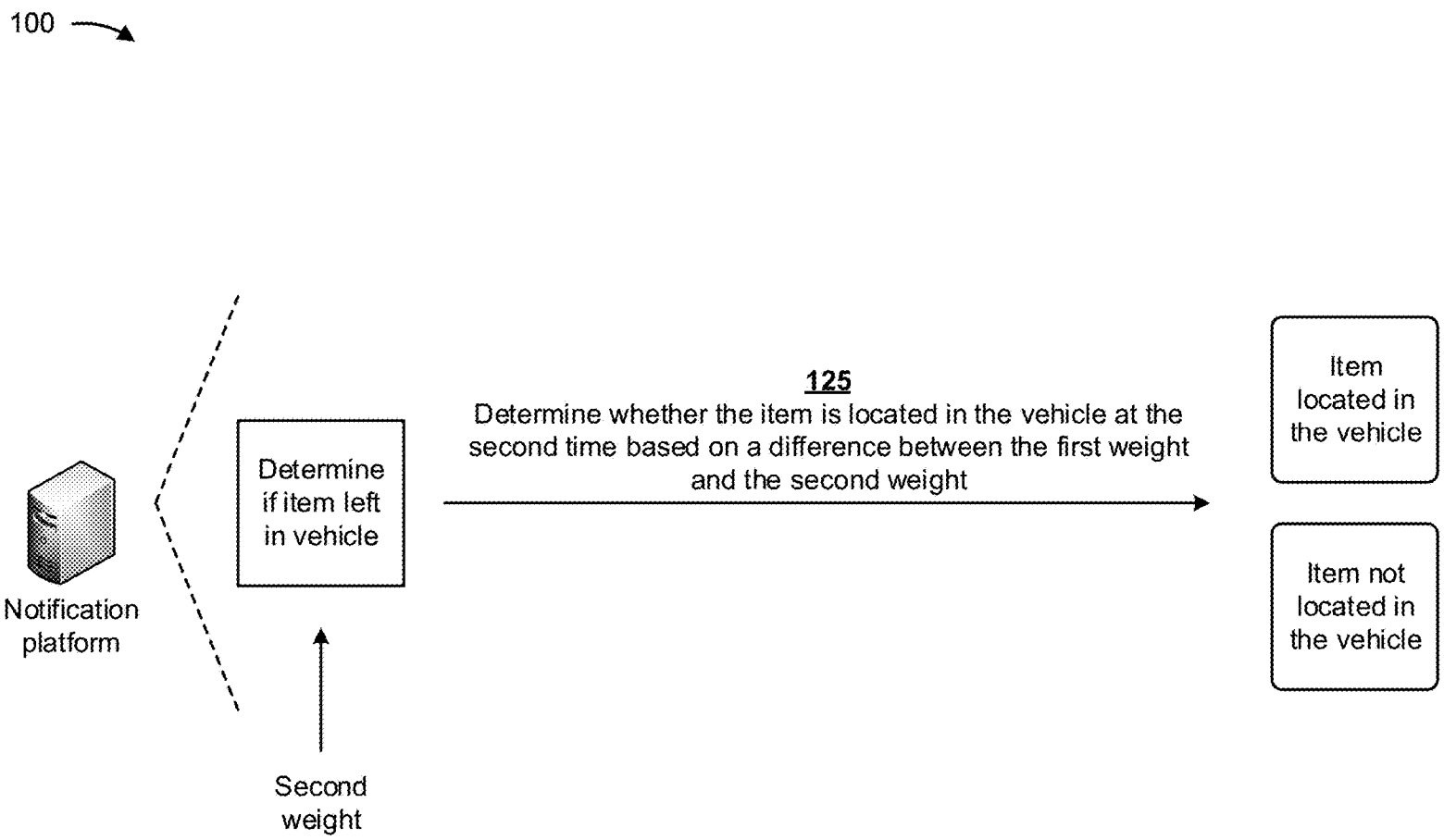

As shown in FIG. 1C, and by reference number 125, the notification platform may determine whether the item is located in the vehicle at the second time based on a difference between the first weight and the second weight. For example, the notification platform may determine that the item is located in the vehicle at the second time when the difference between the first weight and the second weight satisfies a threshold value (e.g., is greater than zero). Alternatively, the notification platform may determine that the item is not located in the vehicle at the second time when the difference between the first weight and the second weight fails to satisfy the threshold value (e.g., is substantially equivalent to zero). In some implementations, the first weight and the second weight may be normalized to zero to account for weights associated with a seat of the vehicle, a carpet of the vehicle, and/or the like. In this way, if the item is not located in the vehicle at the second time, the first weight and the second weight may indicate a value of zero.

Figure 1D:
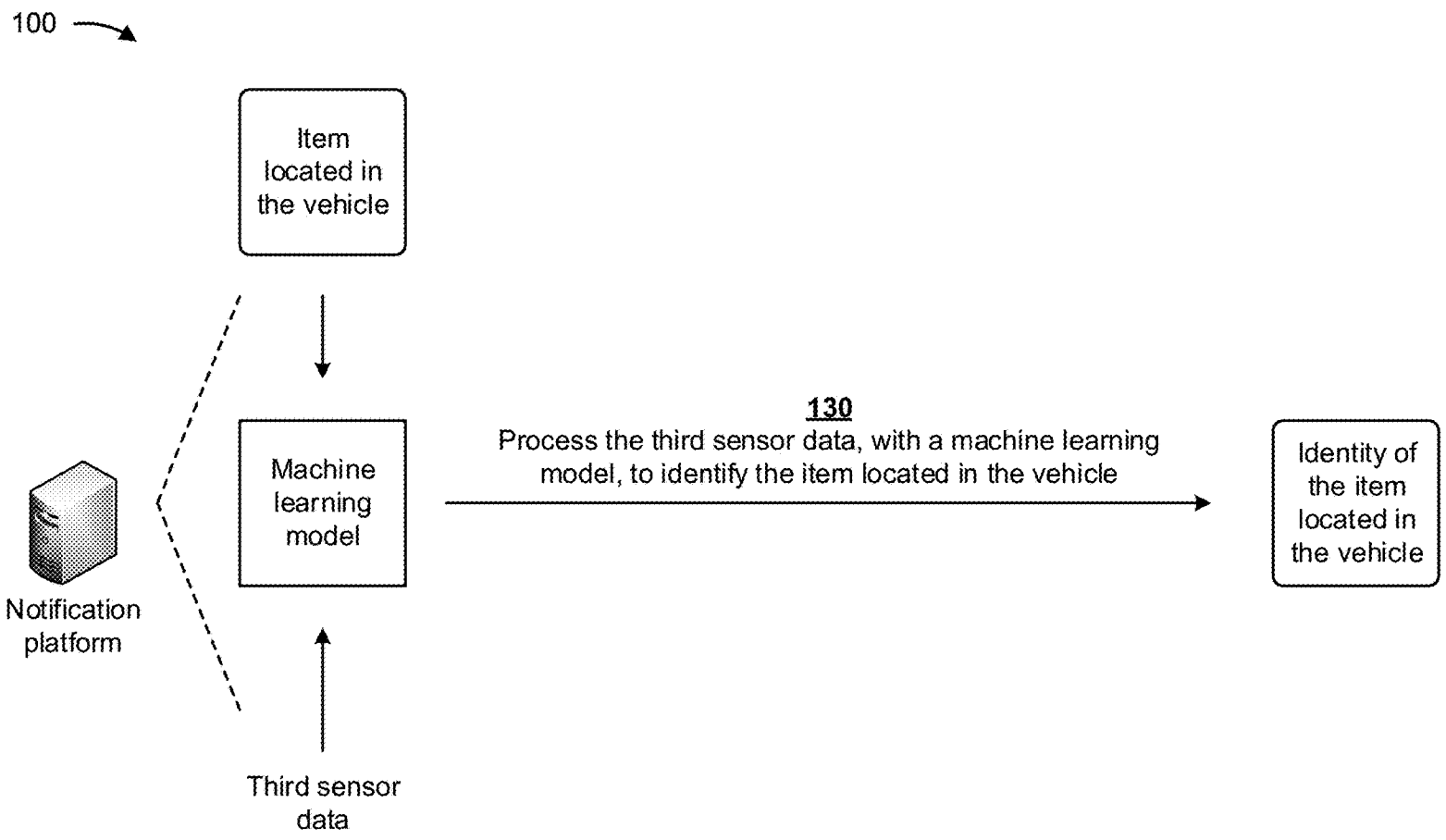

As shown in FIG. 1D, and by reference number 130, the notification platform may process third sensor data, with a machine learning model, to identify the item located in the vehicle at the second time. In some implementations, the notification platform may receive, at the second time, third sensor data from another sensor associated with the vehicle when the notification platform determines that the item is located in the vehicle. The notification platform may verify that the item is located in the vehicle at the second time based on the third sensor data. The other sensor may include, for example, a camera, a radar sensor, a sound sensor, a motion sensor, and/or the like. In some implementations, the machine learning model may be trained to analyze sensor data and to identify an object (e.g., an item) based on analyzing the sensor data. For example, the machine learning model may be trained to analyze image data (e.g., from a camera) and to perform object recognition based on analyzing the image data. In some implementations, the notification platform may provide, to the user device associated with the passenger and/or the driver, information identifying the item left behind in the vehicle (e.g., "It appears that a bookbag was left in the rear seat of the vehicle," "It appears that a tablet was left in the rear seat of the vehicle," and/or the like).

In some implementations, the notification platform may train the machine learning model, with historical image data with objects, to identify the objects in the image data. For example, the notification platform may separate the historical image data into a training set, a validation set, a test set, and/or the like. The training set may be utilized to train the machine learning model. The validation set may be utilized to validate results of the trained machine learning model. The test set may be utilized to test operation of the machine learning model.

In some implementations, the notification platform may train the machine learning model using, for example, an unsupervised training procedure and based on the historical image data. For example, the notification platform may perform dimensionality reduction to reduce the historical image data to a minimum feature set, thereby reducing resources (e.g., processing resources, memory resources, and/or the like) to train the machine learning model, and may apply a classification technique to the minimum feature set.

In some implementations, the notification platform may use a logistic regression classification technique to determine a categorical outcome (e.g., that the historical image data includes certain objects). Additionally, or alternatively, the notification platform may use a naïve Bayesian classifier technique. In this case, the notification platform may perform binary recursive partitioning to split the historical image data into partitions and/or branches and use the partitions and/or branches to determine outcomes (e.g., that the historical image data includes certain objects). Based on using recursive partitioning, the notification platform may reduce utilization of computing resources relative to manual, linear sorting and analysis of data points, thereby enabling use of thousands, millions, or billions of data points to train the machine learning model, which may result in a more accurate model than using fewer data points.

Additionally, or alternatively, the notification platform may use a support vector machine (SVM) classifier technique to generate a non-linear boundary between data points in the training set. In this case, the non-linear boundary is used to classify test data into a particular class.

Additionally, or alternatively, the notification platform may train the machine learning model using a supervised training procedure that includes receiving input to the machine learning model from a subject matter expert, which may reduce an amount of time, an amount of processing resources, and/or the like to train the machine learning model relative to an unsupervised training procedure. In some implementations, the notification platform may use one or more other model training techniques, such as a neural network technique, a latent semantic indexing technique, and/or the like. For example, the notification platform may perform an artificial neural network processing technique (e.g., using a two-layer feedforward neural network architecture, a three-layer feedforward neural network architecture, and/or the like) to perform pattern recognition with regard to patterns of the historical image data. In this case, using the artificial neural network processing technique may improve the accuracy of the trained machine learning model generated by the notification platform by being more robust to noisy, imprecise, or incomplete data, and by enabling the notification platform to detect patterns and/or trends undetectable to human analysts or systems using less complex techniques.

In some implementations, another system may train the machine learning model as described above, and may provide the trained machine learning model to the notification platform. The notification platform may utilize the trained machine learning model as described above.

Figure 1E:
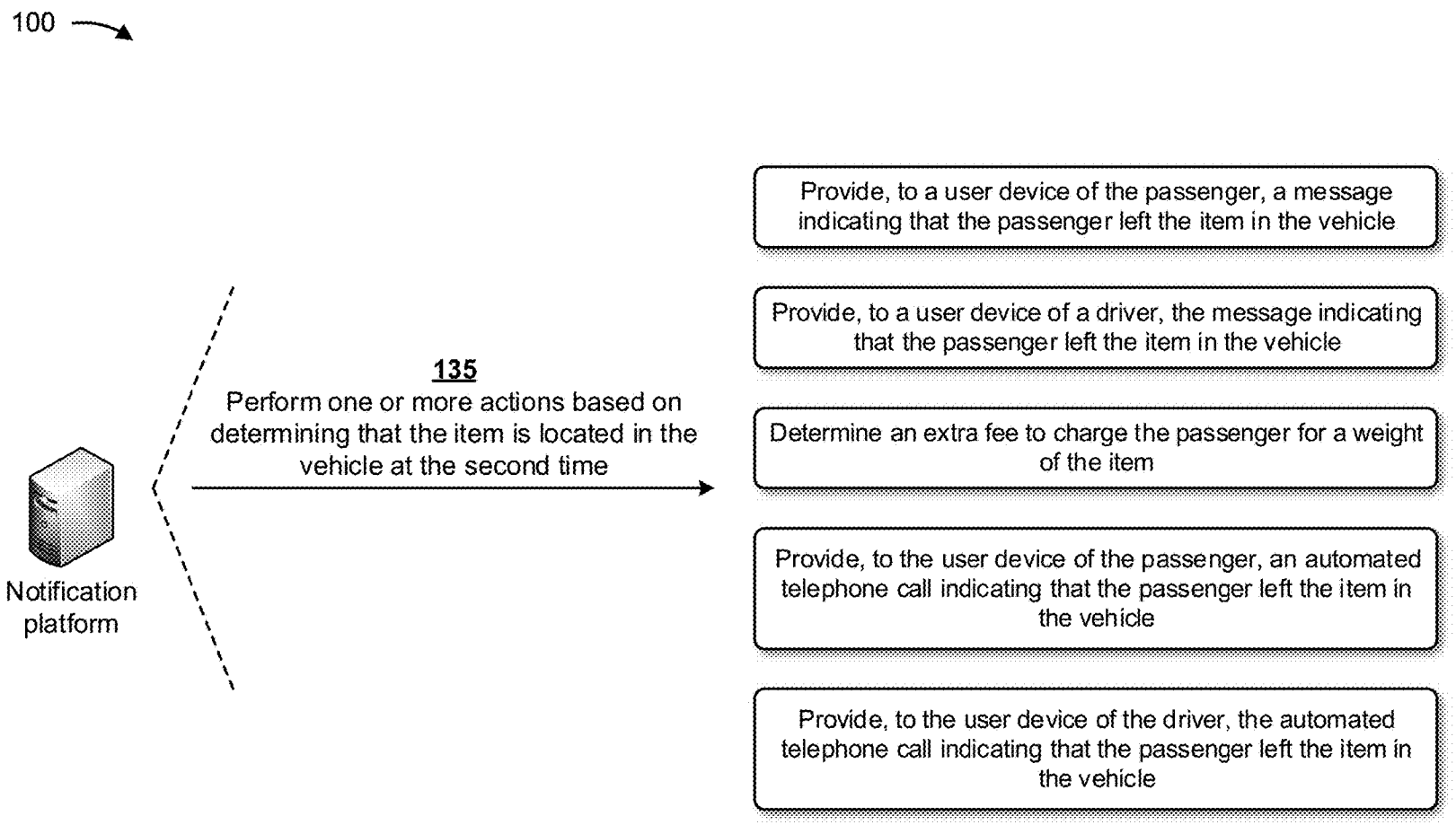

As shown in FIG. 1E, and by reference number 135, the notification platform may perform one or more actions based on determining that the item is located in the vehicle at the second time. In some implementations, the one or more actions may include the notification platform providing, to the user device of the passenger, a message indicating that the passenger left the item in the vehicle (e.g., a text message, an email message, a voice message, and/or the like). The notification platform may provide the message within a threshold amount of time of the passenger exiting the vehicle, such as within five seconds of the passenger exiting the vehicle, within ten seconds of the passenger exiting the vehicle, within thirty seconds of the passenger exiting the vehicle, within one minute of the passenger exiting the vehicle, and/or the like. In some implementations, the notification platform may provide the message within the threshold amount of time of a door of the vehicle being opened or closed (e.g., the notification platform could receive sensor data associated with the door of the vehicle). In this way, the notification platform may timely notify the passenger about the item left in the vehicle prior to the vehicle driving away from the passenger. Thus, the passenger may quickly retrieve the item based on the message, which conserves computing resources (e.g., processing resources, memory resources, and/or the like), network resources, transportation resources, and/or the like that would otherwise be wasted in locating and/or calling the driver, arranging for a pickup or a return of the item, traveling to retrieve the item, transporting the item to the passenger, and/or the like.

In some implementations, the one or more actions may include the notification platform providing, to the user device of the driver, a message indicating that the passenger left the item in the vehicle. In this way, the notification platform may notify the driver about the item left in the vehicle prior to the vehicle driving away from the passenger. The driver may inform the passenger about the left item, based on the message, and the passenger may quickly retrieve the item, which conserves computing resources, network resources, transportation resources, and/or the like that would otherwise be wasted in calling the driver, arranging for a pickup or a return of the item, traveling to retrieve the item, transporting the item to the passenger, and/or the like.

In some implementations, the one or more actions may include the notification platform determining an extra fee to charge the passenger based on the weight of the item. For example, if the item weighs more than a threshold weight, the item may increase fuel consumption by the vehicle. The notification platform may determine a cost associated with the increased fuel consumption and may provide, to the user device of the driver, a recommendation of the extra fee to cover the cost associated with the increased fuel consumption. The driver may charge the extra fee to the passenger, may not charge the extra fee to the passenger but may indicate that the passenger is receiving a discount, and/or the like.

In some implementations, the one or more actions may include the notification platform providing, to the user device of the passenger, an automated telephone call indicating that the passenger left the item in the vehicle. In this way, the notification platform may notify the passenger about the item left in the vehicle prior to the vehicle driving away from the passenger. Thus, the passenger may quickly retrieve the item based on the telephone call, which conserves computing resources, network resources, transportation resources, and/or the like that would otherwise be wasted in calling the driver, arranging for a pickup or a return of the item, traveling to retrieve the item, transporting the item to the passenger, and/or the like.

In some implementations, the one or more actions may include the notification platform providing, to the user device of the driver, an automated telephone call indicating that the passenger left the item in the vehicle. In this way, the notification platform may notify the driver about the item left in the vehicle prior to the vehicle driving away from the passenger. The driver may inform the passenger about the left item, based on the telephone call, and the passenger may quickly retrieve the item, which conserves computing resources, network resources, transportation resources, and/or the like that would otherwise be wasted in calling the driver, arranging for a pickup or a return of the item, traveling to retrieve the item, transporting the item to the passenger, and/or the like.

In some implementations, the one or more actions may include the notification platform providing, to the driver, a haptic alert indicating that the passenger left the item in the vehicle. For example, the notification platform may provide, to a vehicle control system of the vehicle and/or the user device of the driver, information that causes the vehicle control system and/or the user device to generate the haptic alert. The driver may inform the passenger about the left item, based on the haptic alert, and the passenger may quickly retrieve the item, which conserves computing resources, network resources, transportation resources, and/or the like that would otherwise be wasted in calling the driver, arranging for a pickup or a return of the item, traveling to retrieve the item, transporting the item to the passenger, and/or the like.

In some implementations, the one or more actions may include the notification platform triggering a ride share service to bill the passenger or triggering a taxicab service to bill the passenger (e.g., after the item is not determined to be located in the vehicle at the second time).

In some implementations, the one or more actions may include the notification platform utilizing third sensor data (e.g., from a camera) to identify the item, notify the passenger and/or the driver about the identity of the item, provide an image of the item, and/or the like.

In some implementations, when the item is not located in the vehicle, the one or more actions may include the notification platform deleting the sensor data from memory of the notification platform, which may free up memory space.

Figure 1F:
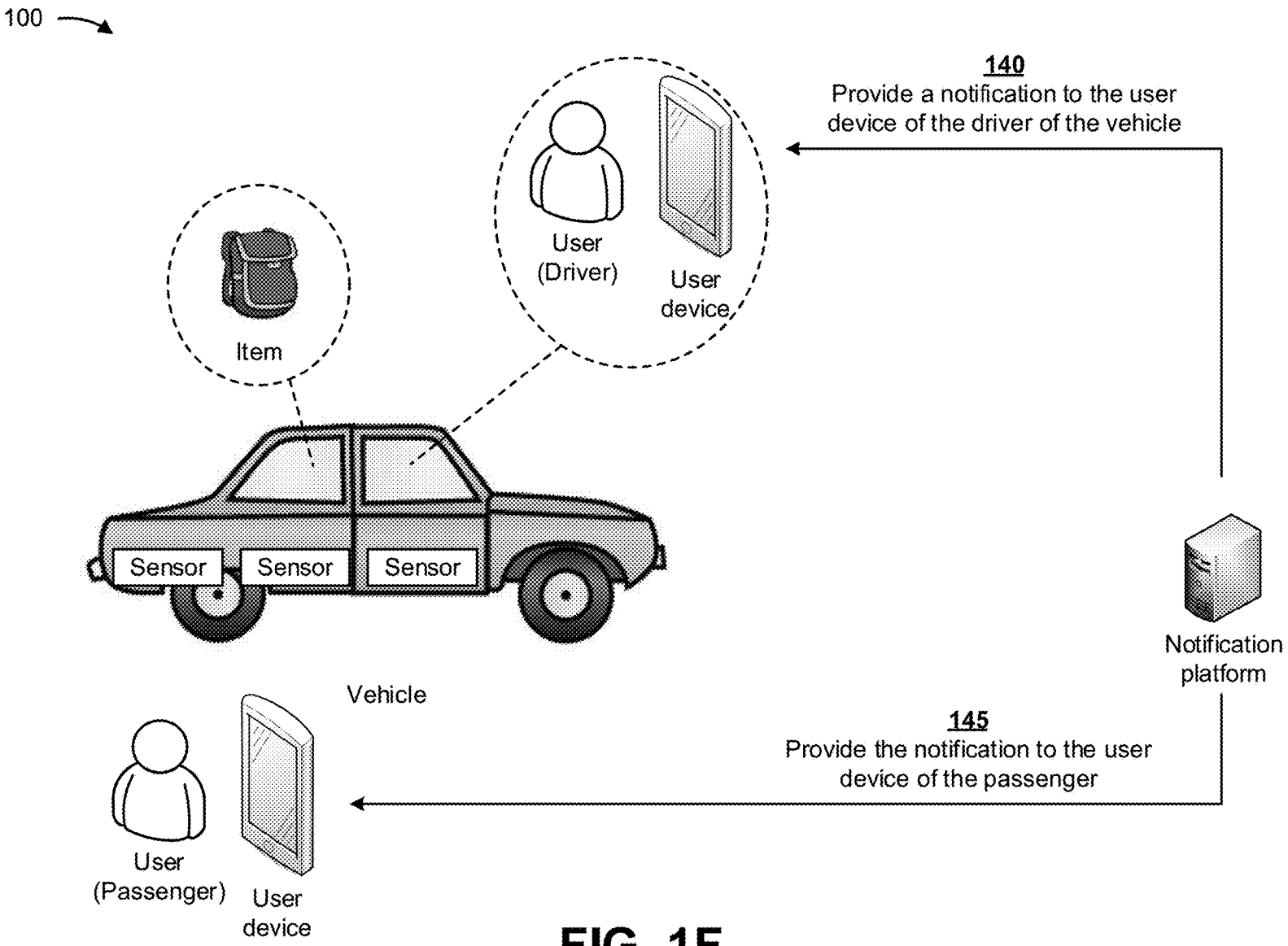

As shown in FIG. 1F, and by reference number 140, the notification platform may provide a notification to the user device of the driver. In some implementations, the notification may indicate that the passenger left the item in the vehicle and the user device may display the notification to the driver. The notification platform may provide the notification to the user device of the driver at the second time, when the passenger exits the vehicle, when the driver selects an end ride function for the passenger, and/or the like. The driver may inform the passenger about the left item, based on the notification, and the passenger may quickly retrieve the item, which conserves computing resources, network resources, transportation resources, and/or the like.

As further shown in FIG. 1F, and by reference number 145, the notification platform may provide a notification to the user device of the passenger. In some implementations, the notification may indicate that the passenger left the item in the vehicle and the user device may display the notification to the passenger. The notification platform may provide the notification to the user device of the passenger at the second time (e.g., simultaneously with the notification provided to the user device of the driver), when the passenger exits the vehicle, when the passenger selects an end ride function, when the passenger authorizes a payment function, and/or the like. The passenger may quickly retrieve the item, based on the notification, which conserves computing resources, network resources, transportation resources, and/or the like.

Figure 1G:
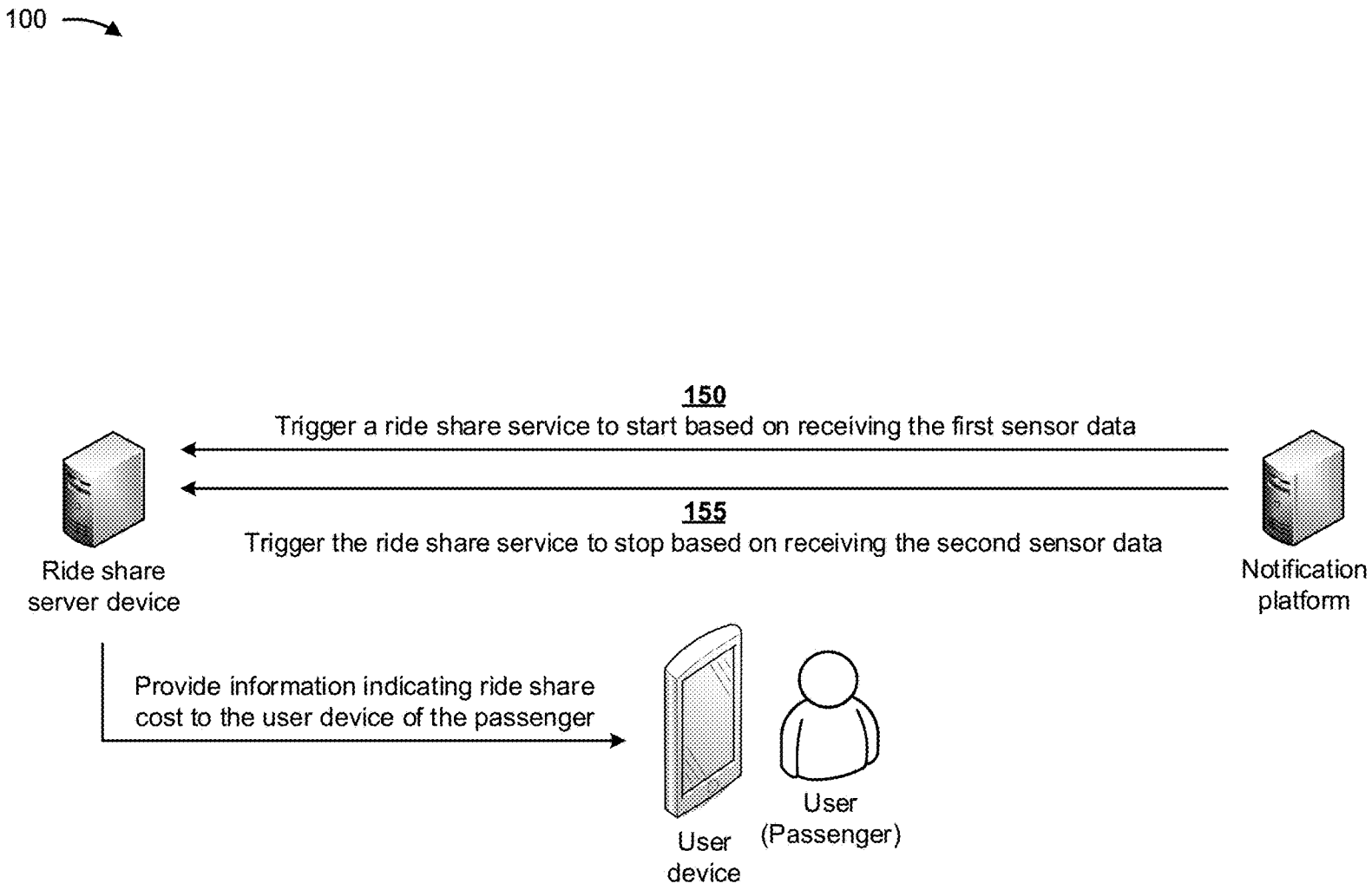

As shown in FIG. 1G, and by reference number 150, the notification platform may trigger a ride share service, a taxicab service, and/or the like, to start charging the passenger based on receiving the first sensor data (e.g., when the passenger enters the vehicle). In some implementations, when the first sensor data is received, the notification platform may provide, to a ride share server device, a message indicating that the ride share service is to start charging the passenger. The ride share server device may receive the message and may start charging the passenger for the ride share service of the vehicle based on receiving the message.

As further shown in FIG. 1G, and by reference number 155, the notification platform may trigger the ride share service, the taxicab service, and/or the like, to stop charging the passenger based on receiving the second sensor data (e.g., when the passenger exits the vehicle). In some implementations, when the second sensor data is received, the notification platform may provide, to the ride share server device, a message indicating that the ride share service is to stop charging the passenger. The ride share server device may receive the message and may stop charging the passenger for the ride share service of the vehicle based on receiving the message. The ride share server device may calculate a ride share cost for the passenger based on when the ride share service is started and stopped. As further shown, the ride share server device may provide information indicating the ride share cost to the user device of the passenger. The user device of the passenger may display the ride share cost to the passenger and the passenger may utilize the user device to pay for the ride share cost.

Figure 1H:
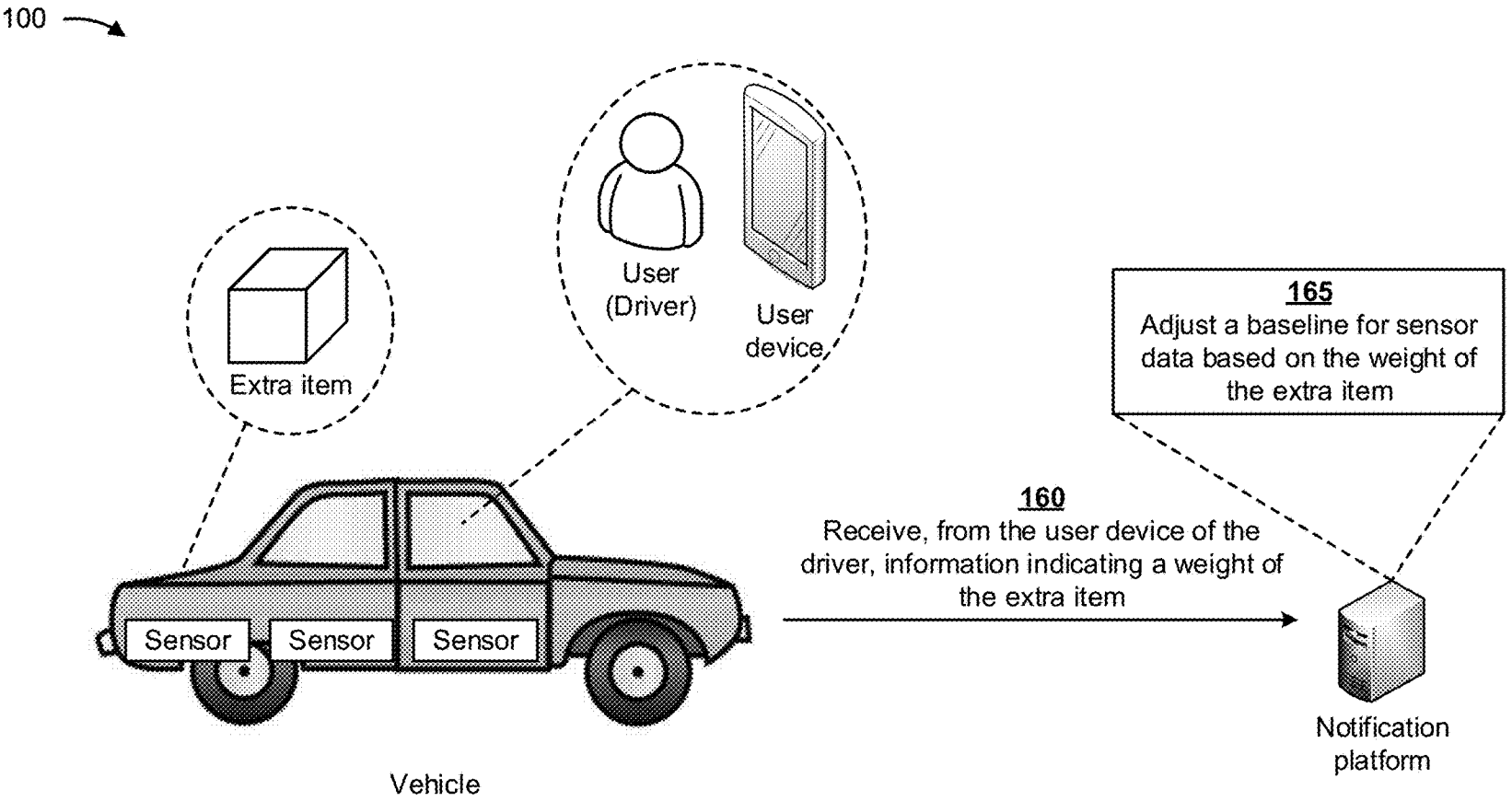

As shown in FIG. 1H, in some implementations, the driver may store an extra item in the trunk of the vehicle prior to the passenger entering the vehicle. As further shown in FIG. 1H, and by reference number 160, the notification platform may receive, prior to the passenger entering the vehicle, information indicating a weight of the extra item located in the trunk of the vehicle. In some implementations, the information indicating the weight of the extra item may be received from a sensor of the vehicle based on a command from the user device associated with the driver of the vehicle.

As further shown in FIG. 1H, and by reference number 165, the notification platform may adjust a baseline for the first sensor data and the second sensor data based on the weight of the extra item. In some implementations, in order to reduce or eliminate a chance of generating false notifications indicating that passengers left items in the vehicle, the notification platform may adjust the baseline, for sensor data received from the sensors, to account for the weight of the extra item. For example, the notification platform may reduce the first weight and the second weight by the weight of the extra item so that the weight of the extra item does not factor in the comparison of the first weight and the second weight.

Figure 1I:
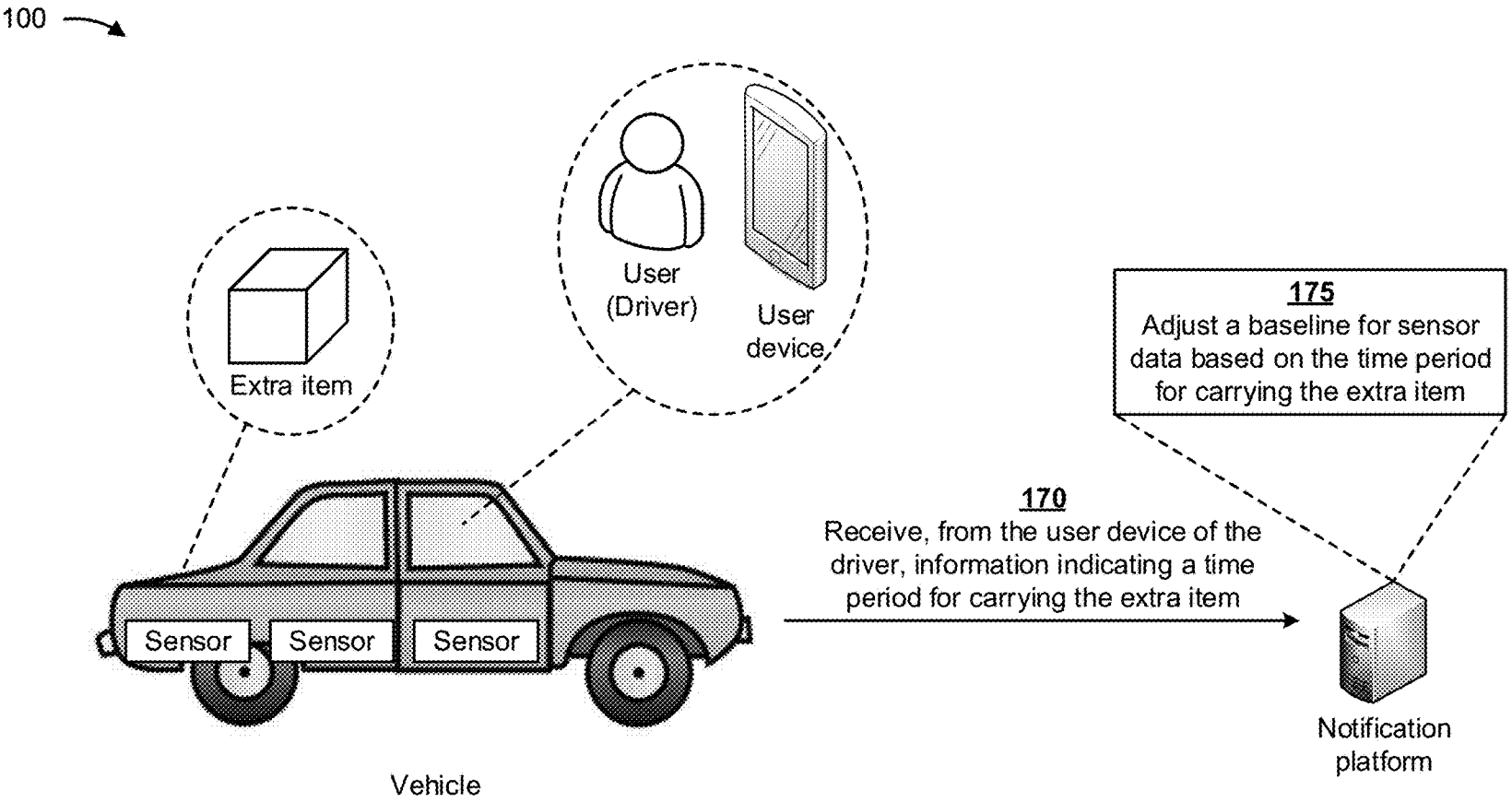

As shown in FIG. 1I, and by reference number 170, the notification platform may receive, prior to the passenger entering the vehicle, information indicating a time period for carrying the extra item located in the vehicle. In some implementations, the information indicating the time period for carrying the extra item may be received from the user device associated with a driver of the vehicle.

As further shown in FIG. 1I, and by reference number 175, the notification platform may adjust the baseline for the first sensor data and the second sensor data based on the time period for carrying the extra item. In some implementations, in order to reduce or eliminate a chance of generating false notifications indicating that passengers left items in the vehicle, the notification platform may adjust the baseline, for sensor data received from the sensors, to account for the time period for carrying the extra item. For example, the notification may reduce the first weight and the second weight by the weight of the extra item, during the time period, so that the weight of the extra item does not factor in the comparison of the first weight and the second weight.

In some implementations, if the vehicle is not equipped with sensors, a vehicle control system of the vehicle may provide, to the notification platform, fuel consumption data associated with the first time and the second time. The notification platform may determine whether the passenger left the item in the vehicle based on the fuel consumption data. In some implementations, the functions described above may be performed based on image data, video data, and/or the like, if weight data is not available.

Although implementations are described in connection with identifying left items in vehicles, the implementations described herein may be utilized to perform other services, such as to determine that a correct package is delivered, to determine that all packages have been delivered, to determine weights of cargo or packages, to determine a weight of garbage received by a garbage truck, and/or the like.

In this way, several different stages of the process for utilizing sensor data to identify an item left in a vehicle and to perform actions based on identifying the left item may be automated, which may improve speed and efficiency of the process and conserve computing resources (e.g., processing resources, memory resources, and/or the like). Furthermore, implementations described herein use a rigorous, computerized process to perform tasks or roles that were not previously performed. For example, currently there does not exist a technique that utilizes sensor data to identify an item left in a vehicle and to perform actions based on identifying the left item. Further, the process for utilizing sensor data to identify an item left in a vehicle and to perform actions based on identifying the left item conserves resources (e.g., processing resources, memory resources, network resources, transportation resources, and/or the like) that would otherwise be wasted in retrieving lost items in vehicles, replacing lost items, and/or the like.

As indicated above, FIGS. 1A-1I are provided merely as examples. Other examples may differ from what is described with regard to FIGS. 1A-1I.

Figure 2:
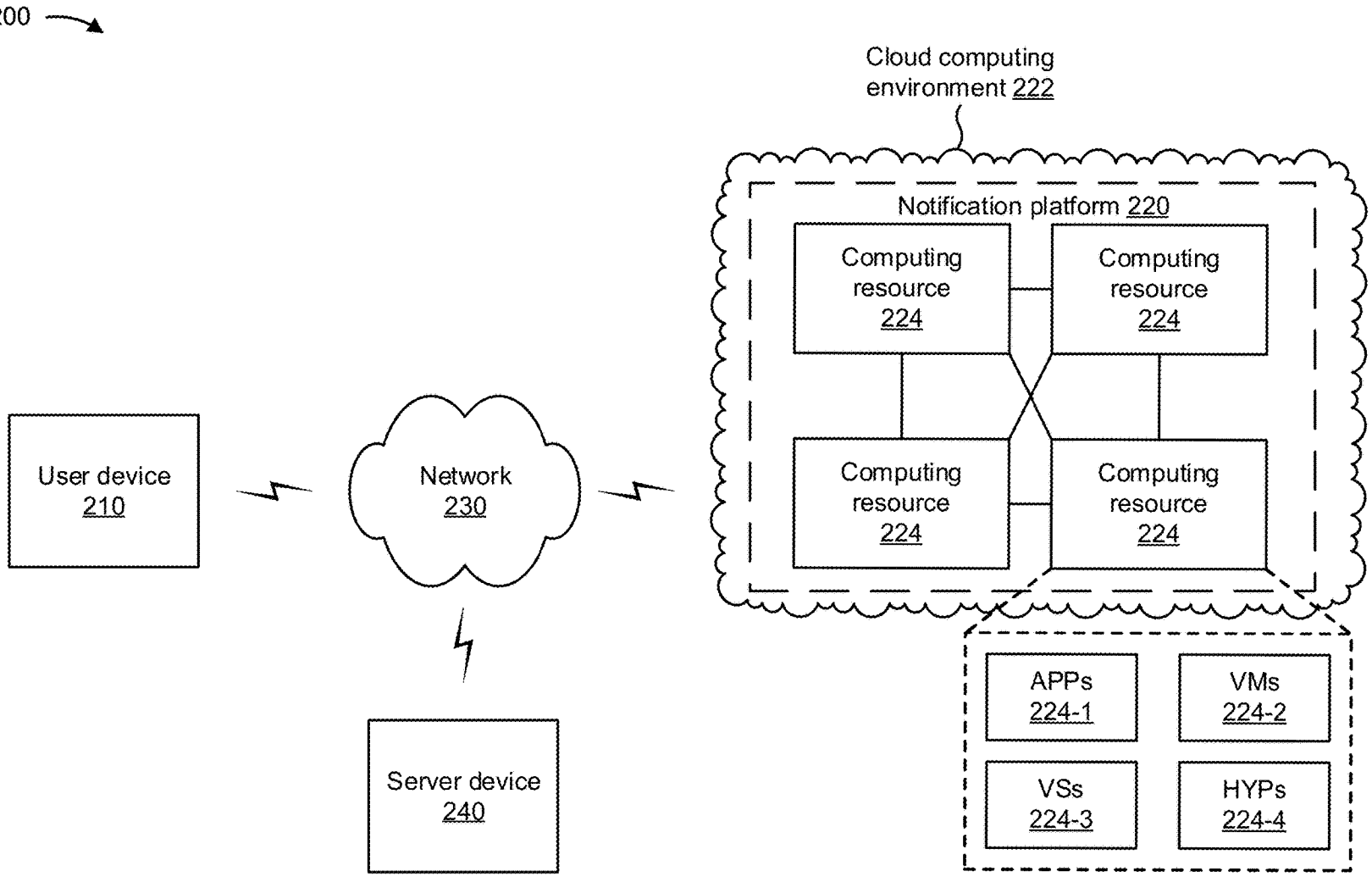
FIG. 2 is a diagram of an example environment in which systems and/or methods described herein may be implemented.

FIG. 2 is a diagram of an example environment 200 in which systems and/or methods, described herein, may be implemented. As shown in FIG. 2, environment 200 may include a user device 210, a notification platform 220, a network 230, and a server device 240. Devices of environment 200 may interconnect via wired connections, wireless connections, or a combination of wired and wireless connections.

User device 210 includes one or more devices capable of receiving, generating, storing, processing, and/or providing information, such as information described herein. For example, user device 210 may include a mobile phone (e.g., a smart phone, a radiotelephone, etc.), a laptop computer, a tablet computer, a desktop computer, a handheld computer, a gaming device, a wearable communication device (e.g., a smart wristwatch, a pair of smart eyeglasses, etc.), or a similar type of device. In some implementations, user device 210 may receive information from and/or transmit information to notification platform 220 and/or server device 240.

Notification platform 220 includes one or more devices that may utilize sensor data to identify an item left in a vehicle and to perform actions based on identifying the left item. In some implementations, notification platform 220 may be modular such that certain software components may be swapped in or out depending on a particular need. As such, notification platform 220 may be easily and/or quickly reconfigured for different uses. In some implementations, notification platform 220 may receive information from and/or transmit information to one or more user devices 210 and/or server devices 240.

In some implementations, as shown, notification platform 220 may be hosted in a cloud computing environment 222. Notably, while implementations described herein describe notification platform 220 as being hosted in cloud computing environment 222, in some implementations, notification platform 220 may be non-cloud-based (i.e., may be implemented outside of a cloud computing environment) or may be partially cloud-based.

Cloud computing environment 222 includes an environment that may host notification platform 220. Cloud computing environment 222 may provide computation, software, data access, storage, etc. services that do not require end-user knowledge of a physical location and configuration of system(s) and/or device(s) that host notification platform 220. As shown, cloud computing environment 222 may include a group of computing resources 224 (referred to collectively as "computing resources 224" and individually as "computing resource 224").

Computing resource 224 includes one or more personal computers, workstation computers, server devices, or other types of computation and/or communication devices. In some implementations, computing resource 224 may host notification platform 220. The cloud resources may include compute instances executing in computing resource 224, storage devices provided in computing resource 224, data transfer devices provided by computing resource 224, etc. In some implementations, computing resource 224 may communicate with other computing resources 224 via wired connections, wireless connections, or a combination of wired and wireless connections.

As further shown in FIG. 2, computing resource 224 includes a group of cloud resources, such as one or more applications ("APPs") 224-1, one or more virtual machines ("VMs") 224-2, virtualized storage ("VSs") 224-3, one or more hypervisors ("HYPs") 224-4, and/or the like.

Application 224-1 includes one or more software applications that may be provided to or accessed by user device 210. Application 224-1 may eliminate a need to install and execute the software applications on user device 210. For example, application 224-1 may include software associated with notification platform 220 and/or any other software capable of being provided via cloud computing environment 222. In some implementations, one application 224-1 may send/receive information to/from one or more other applications 224-1, via virtual machine 224-2.

Virtual machine 224-2 includes a software implementation of a machine (e.g., a computer) that executes programs like a physical machine. Virtual machine 224-2 may be either a system virtual machine or a process virtual machine, depending upon use and degree of correspondence to any real machine by virtual machine 224-2. A system virtual machine may provide a complete system platform that supports execution of a complete operating system ("OS"). A process virtual machine may execute a single program and may support a single process. In some implementations, virtual machine 224-2 may execute on behalf of a user (e.g., a user of user device 210 or an operator of notification platform 220), and may manage infrastructure of cloud computing environment 222, such as data management, synchronization, or long-duration data transfers.

Virtualized storage 224-3 includes one or more storage systems and/or one or more devices that use virtualization techniques within the storage systems or devices of computing resource 224. In some implementations, within the context of a storage system, types of virtualizations may include block virtualization and file virtualization. Block virtualization may refer to abstraction (or separation) of logical storage from physical storage so that the storage system may be accessed without regard to physical storage or heterogeneous structure. The separation may provide administrators of the storage system with flexibility in how the administrators manage storage for end users. File virtualization may eliminate dependencies between data accessed at a file level and a location where files are physically stored. This may enable optimization of storage use, server consolidation, and/or performance of non-disruptive file migrations.

Hypervisor 224-4 may provide hardware virtualization techniques that allow multiple operating systems (e.g., "guest operating systems") to execute concurrently on a host computer, such as computing resource 224. Hypervisor 224-4 may present a virtual operating platform to the guest operating systems and may manage the execution of the guest operating systems. Multiple instances of a variety of operating systems may share virtualized hardware resources.

Network 230 includes one or more wired and/or wireless networks. For example, network 230 may include a cellular network (e.g., a fifth generation (5G) network, a long-term evolution (LTE) network, a third generation (3G) network, a code division multiple access (CDMA) network, etc.), a public land mobile network (PLMN), a local area network (LAN), a wide area network (WAN), a metropolitan area network (MAN), a telephone network (e.g., the Public Switched Telephone Network (PSTN)), a private network, an ad hoc network, an intranet, the Internet, a fiber optic-based network, and/or the like, and/or a combination of these or other types of networks.

Server device 240 includes one or more devices capable of receiving, generating, storing, processing, and/or providing information, such as information described herein. For example, server device 240 may include a laptop computer, a tablet computer, a desktop computer, a group of server devices, or a similar type of device, associated with a ride share service, a taxicab service, and/or the like. In some implementations, server device 240 may receive information from and/or transmit information to user device 210 and/or notification platform 220.

The number and arrangement of devices and networks shown in FIG. 2 are provided as an example. In practice, there may be additional devices and/or networks, fewer devices and/or networks, different devices and/or networks, or differently arranged devices and/or networks than those shown in FIG. 2. Furthermore, two or more devices shown in FIG. 2 may be implemented within a single device and/or a single device shown in FIG. 2 may be implemented as multiple, distributed devices. Additionally, or alternatively, a set of devices (e.g., one or more devices) of environment 200 may perform one or more functions described as being performed by another set of devices of environment 200.

Figure 3:
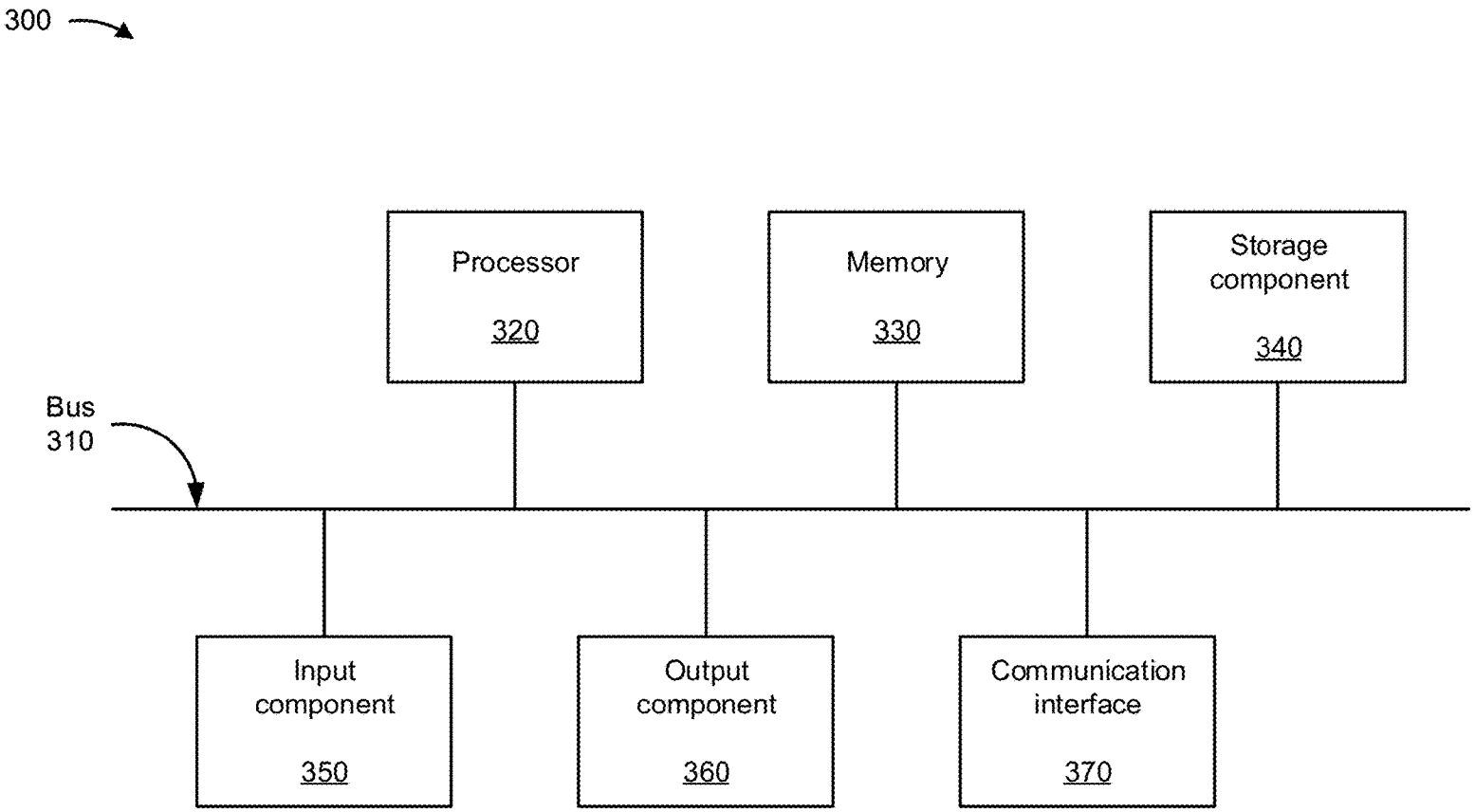
FIG. 3 is a diagram of example components of one or more devices of FIG. 2.

FIG. 3 is a diagram of example components of a device 300. Device 300 may correspond to user device 210, notification platform 220, computing resource 224, and/or server device 240. In some implementations, user device 210, notification platform 220, computing resource 224, and/or server device 240 may include one or more devices 300 and/or one or more components of device 300. As shown in FIG. 3, device 300 may include a bus 310, a processor 320, a memory 330, a storage component 340, an input component 350, an output component 360, and/or a communication interface 370.

Bus 310 includes a component that permits communication among the components of device 300. Processor 320 is implemented in hardware, firmware, or a combination of hardware and software. Processor 320 is a central processing unit (CPU), a graphics processing unit (GPU), an accelerated processing unit (APU), a microprocessor, a microcontroller, a digital signal processor (DSP), a field-programmable gate array (FPGA), an application-specific integrated circuit (ASIC), or another type of processing component. In some implementations, processor 320 includes one or more processors capable of being programmed to perform a function. Memory 330 includes a random-access memory (RAM), a read only memory (ROM), and/or another type of dynamic or static storage device (e.g., a flash memory, a magnetic memory, and/or an optical memory) that stores information and/or instructions for use by processor 320.

Storage component 340 stores information and/or software related to the operation and use of device 300. For example, storage component 340 may include a hard disk (e.g., a magnetic disk, an optical disk, a magneto-optic disk, and/or a solid-state disk), a compact disc (CD), a digital versatile disc (DVD), a floppy disk, a cartridge, a magnetic tape, and/or another type of non-transitory computer-readable medium, along with a corresponding drive.

Input component 350 includes a component that permits device 300 to receive information, such as via user input (e.g., a touch screen display, a keyboard, a keypad, a mouse, a button, a switch, and/or a microphone). Additionally, or alternatively, input component 350 may include a sensor for sensing information (e.g., a global positioning system (GPS) component, an accelerometer, a gyroscope, and/or an actuator). Output component 360 includes a component that provides output information from device 300 (e.g., a display, a speaker, and/or one or more light-emitting diodes (LEDs)).

Communication interface 370 includes a transceiver-like component (e.g., a transceiver and/or a separate receiver and transmitter) that enables device 300 to communicate with other devices, such as via a wired connection, a wireless connection, or a combination of wired and wireless connections. Communication interface 370 may permit device 300 to receive information from another device and/or provide information to another device. For example, communication interface 370 may include an Ethernet interface, an optical interface, a coaxial interface, an infrared interface, a radio frequency (RF) interface, a universal serial bus (USB) interface, a Wi-Fi interface, a cellular network interface, and/or the like.

Device 300 may perform one or more processes described herein. Device 300 may perform these processes based on processor 320 executing software instructions stored by a non-transitory computer-readable medium, such as memory 330 and/or storage component 340. A computer-readable medium is defined herein as a non-transitory memory device. A memory device includes memory space within a single physical storage device or memory space spread across multiple physical storage devices.

Software instructions may be read into memory 330 and/or storage component 340 from another computer-readable medium or from another device via communication interface 370. When executed, software instructions stored in memory 330 and/or storage component 340 may cause processor 320 to perform one or more processes described herein. Additionally, or alternatively, hardwired circuitry may be used in place of or in combination with software instructions to perform one or more processes described herein. Thus, implementations described herein are not limited to any specific combination of hardware circuitry and software.

The number and arrangement of components shown in FIG. 3 are provided as an example. In practice, device 300 may include additional components, fewer components, different components, or differently arranged components than those shown in FIG. 3. Additionally, or alternatively, a set of components (e.g., one or more components) of device 300 may perform one or more functions described as being performed by another set of components of device 300.

Figure 4:
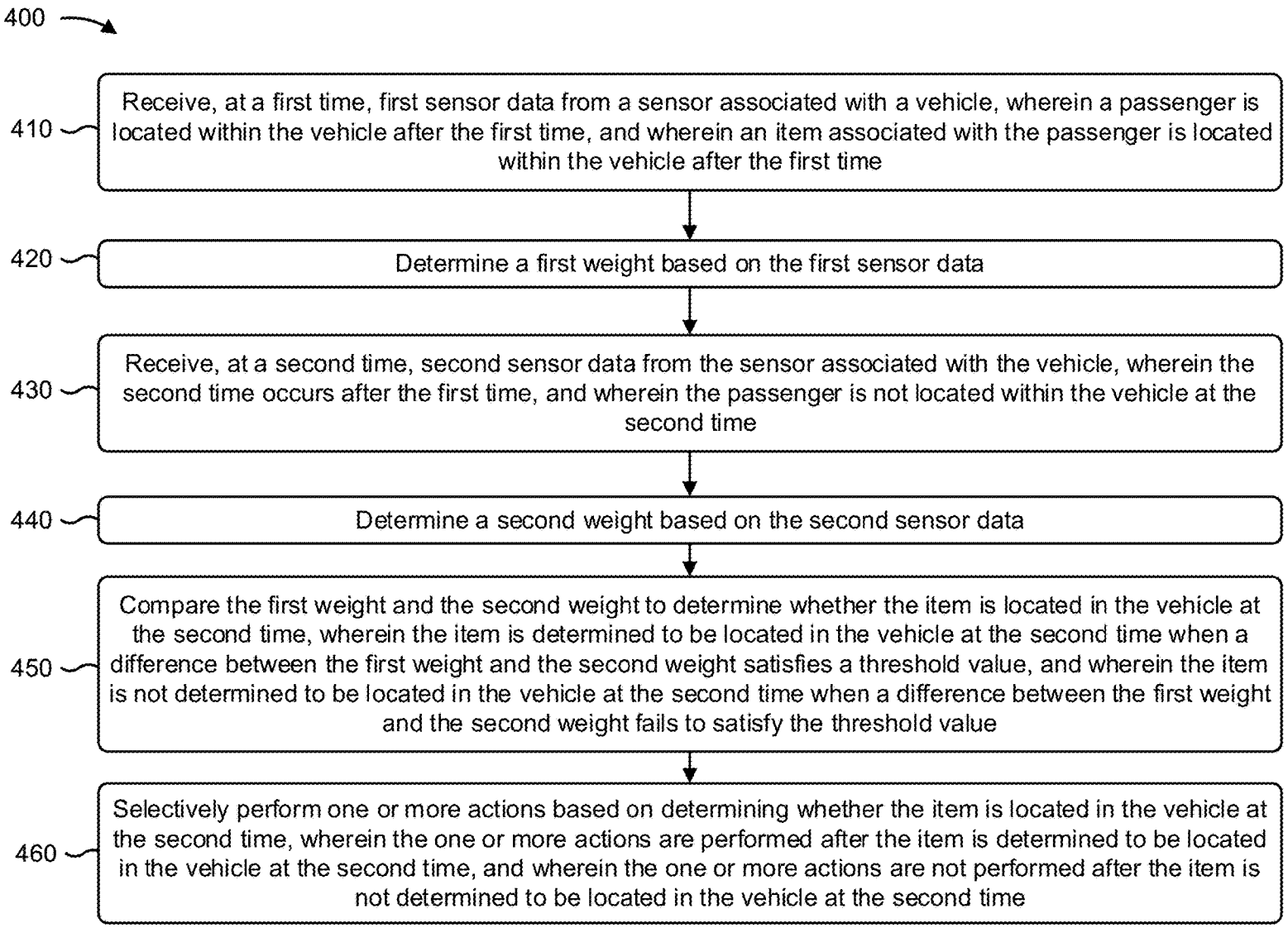
FIGS. 4-6 are flow charts of example processes for utilizing sensor data to identify an item left in a vehicle and to perform actions based on identifying the left item.

FIG. 4 is a flow chart of an example process 400 for utilizing sensor data to identify an item left in a vehicle and to perform actions based on identifying the left item. In some implementations, one or more process blocks of FIG. 4 may be performed by a notification platform (e.g., notification platform 220). In some implementations, one or more process blocks of FIG. 4 may be performed by another device or a group of devices separate from or including the notification platform, such as a user device (e.g., user device 210) and/or a server device (e.g., server device 240).

As shown in FIG. 4, process 400 may include receiving, at a first time, first sensor data from a sensor associated with a vehicle, wherein a passenger is located within the vehicle after the first time and wherein an item associated with the passenger is located within the vehicle after the first time (block 410). For example, the notification platform (e.g., using computing resource 224, processor 320, communication interface 370, and/or the like) may receive, at a first time, first sensor data from a sensor associated with a vehicle, as described above. In some implementations, a passenger may be located within the vehicle after the first time and an item associated with the passenger may be located within the vehicle after the first time.

As further shown in FIG. 4, process 400 may include determining a first weight based on the first sensor data (block 420). For example, the notification platform (e.g., using computing resource 224, processor 320, memory 330, and/or the like) may determine a first weight based on the first sensor data, as described above.

As further shown in FIG. 4, process 400 may include receiving, at a second time, second sensor data from the sensor associated with the vehicle, wherein the second time occurs after the first time and wherein the passenger is not located within the vehicle at the second time (block 430). For example, the notification platform (e.g., using computing resource 224, processor 320, communication interface 370, and/or the like) may receive, at a second time, second sensor data from the sensor associated with the vehicle, as described above. In some implementations, the second time occurs after the first time. In some implementations, the second time may occur after the first time and wherein the passenger may not be located within the vehicle at the second time.

As further shown in FIG. 4, process 400 may include determining a second weight based on the second sensor data (block 440). For example, the notification platform (e.g., using computing resource 224, processor 320, storage component 340, and/or the like) may determine a second weight based on the second sensor data, as described above.

As further shown in FIG. 4, process 400 may include comparing the first weight and the second weight to determine whether the item is located in the vehicle at the second time, wherein the item is determined to be located in the vehicle at the second time when a difference between the first weight and the second weight satisfies a threshold value and wherein the item is not determined to be located in the vehicle at the second time when a difference between the first weight and the second weight fails to satisfy the threshold value (block 450). For example, the notification platform (e.g., using computing resource 224, processor 320, memory 330, and/or the like) may compare the first weight and the second weight to determine whether the item is located in the vehicle at the second time, as described above. In some implementations, the item may be determined to be located in the vehicle at the second time when a difference between the first weight and the second weight satisfies a threshold value, and the item may not be determined to be located in the vehicle at the second time when a difference between the first weight and the second weight fails to satisfy the threshold value.

As further shown in FIG. 4, process 400 may include selectively performing one or more actions based on determining whether the item is located in the vehicle at the second time, wherein the one or more actions are performed after the item is determined to be located in the vehicle at the second time and wherein the one or more actions are not performed after the item is not determined to be located in the vehicle at the second time (block 460). For example, the notification platform (e.g., using computing resource 224, processor 320, memory 330, storage component 340, communication interface 370, and/or the like) may selectively perform one or more actions based on determining whether the item is located in the vehicle at the second time, as described above. In some implementations, the one or more actions may be performed after the item is determined to be located in the vehicle at the second time and the one or more actions may not be performed after the item is not determined to be located in the vehicle at the second time.

Process 400 may include additional implementations, such as any single implementation or any combination of implementations described below and/or in connection with one or more other processes described elsewhere herein.

In a first implementation, after the item is determined to be located in the vehicle at the second time and when performing the one or more actions, the notification platform may one or more provide, to a user device of the passenger, a first message indicating that the passenger left the item in the vehicle, may provide, to a user device of a driver of the vehicle, a second message indicating that the passenger left the item in the vehicle, may provide, to the user device of the passenger, a first automated telephone call indicating that the passenger left the item in the vehicle, may provide, to the user device of the driver, a second automated telephone call indicating that the passenger left the item in the vehicle, or may provide, to the driver, a haptic alert indicating that the passenger left the item in the vehicle.

In a second implementation, alone or in combination with the first implementation, the notification platform may trigger a ride share service to start charging the passenger based on receiving the first sensor data, and may trigger the ride share service to stop charging the passenger based on receiving the second sensor data.

In a third implementation, alone or in combination with one or more of the first and second implementations, the notification platform may receive, prior to the passenger entering the vehicle, information indicating a weight of an extra item located in the vehicle, wherein the information indicating the weight of the extra item is received from a user device associated with a driver of the vehicle, and may adjust a baseline for the first sensor data and the second sensor data based on the weight of the extra item.

In a fourth implementation, alone or in combination with one or more of the first through third implementations, the notification platform may receive, prior to the passenger entering the vehicle, information indicating a time period for carrying an extra item located in the vehicle, wherein the information indicating the time period for carrying the extra item is received from a user device associated with a driver of the vehicle, and may adjust a baseline for the first sensor data and the second sensor data based on the time period for carrying the extra item.

In a fifth implementation, alone or in combination with one or more of the first through fourth implementations, the sensor may include one of a plurality of sensors located at one or more of under a trunk plate of the vehicle, under one or more seats of the vehicle, or under one or more floor panels of the vehicle.

In a sixth implementation, alone or in combination with one or more of the first through fifth implementations, the sensor may include one or more of a piezoelectric weight sensor, a Hall effect weight sensor, or a strain gauge weight sensor.

Although FIG. 4 shows example blocks of process 400, in some implementations, process 400 may include additional blocks, fewer blocks, different blocks, or differently arranged blocks than those depicted in FIG. 4. Additionally, or alternatively, two or more of the blocks of process 400 may be performed in parallel.

Figure 5:
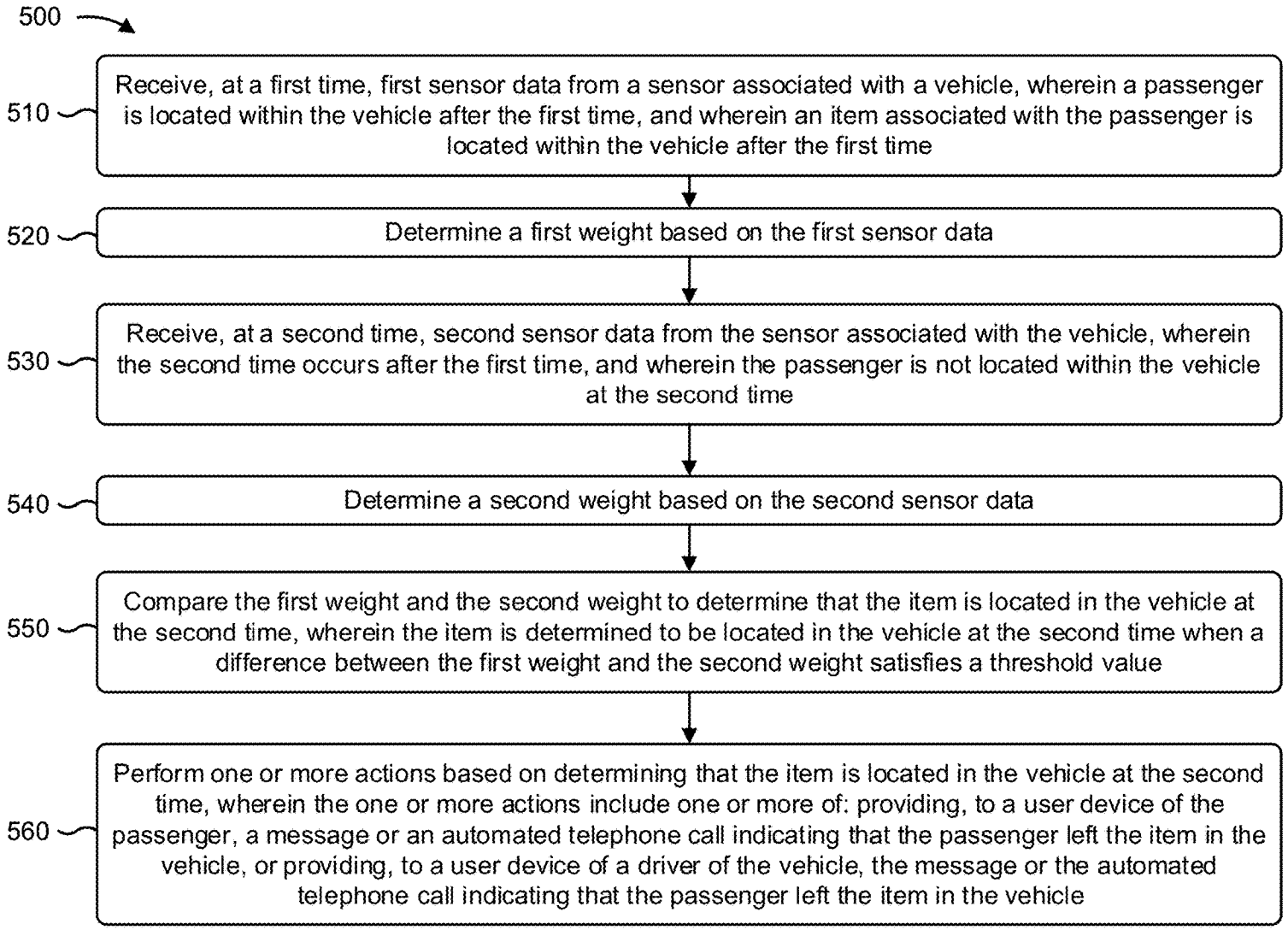

FIG. 5 is a flow chart of an example process 500 for utilizing sensor data to identify an item left in a vehicle and to perform actions based on identifying the left item. In some implementations, one or more process blocks of FIG. 5 may be performed by a notification platform (e.g., notification platform 220). In some implementations, one or more process blocks of FIG. 5 may be performed by another device or a group of devices separate from or including the notification platform, such as a user device (e.g., user device 210) and/or a server device (e.g., server device 240).

As shown in FIG. 5, process 500 may include receiving, at a first time, first sensor data from a sensor associated with a vehicle, wherein a passenger is located within the vehicle after the first time and wherein an item associated with the passenger is located within the vehicle after the first time (block 510). For example, the notification platform (e.g., using computing resource 224, processor 320, communication interface 370, and/or the like) may receive, at a first time, first sensor data from a sensor associated with a vehicle, as described above. In some implementations, a passenger may be located within the vehicle after the first time and an item associated with the passenger may be located within the vehicle after the first time.

As further shown in FIG. 5, process 500 may include determining a first weight based on the first sensor data (block 520). For example, the notification platform (e.g., using computing resource 224, processor 320, memory 330, and/or the like) may determine a first weight based on the first sensor data, as described above.

As further shown in FIG. 5, process 500 may include receiving, at a second time, second sensor data from the sensor associated with the vehicle, wherein the second time occurs after the first time and wherein the passenger is not located within the vehicle at the second time (block 530). For example, the notification platform (e.g., using computing resource 224, processor 320, communication interface 370, and/or the like) may receive, at a second time, second sensor data from the sensor associated with the vehicle, as described above. In some implementations, the second time may occur after the first time and the passenger may not be located within the vehicle at the second time.

As further shown in FIG. 5, process 500 may include determining a second weight based on the second sensor data (block 540). For example, the notification platform (e.g., using computing resource 224, processor 320, storage component 340, and/or the like) may determine a second weight based on the second sensor data, as described above.

As further shown in FIG. 5, process 500 may include comparing the first weight and the second weight to determine that the item is located in the vehicle at the second time, wherein the item is determined to be located in the vehicle at the second time when a difference between the first weight and the second weight satisfies a threshold value (block 550). For example, the notification platform (e.g., using computing resource 224, processor 320, memory 330, and/or the like) may compare the first weight and the second weight to determine that the item is located in the vehicle at the second time, as described above. In some implementations, the item may be determined to be located in the vehicle at the second time when a difference between the first weight and the second weight satisfies a threshold value.

As further shown in FIG. 5, process 500 may include performing one or more actions based on determining that the item is located in the vehicle at the second time, wherein the one or more actions include one or more of providing, to a user device of the passenger, a message or an automated telephone call indicating that the passenger left the item in the vehicle, or providing, to a user device of a driver of the vehicle, the message or the automated telephone call indicating that the passenger left the item in the vehicle (block 560). For example, the notification platform (e.g., using computing resource 224, processor 320, memory 330, storage component 340, communication interface 370, and/or the like) may perform one or more actions based on determining that the item is located in the vehicle at the second time, as described above. In some implementations, the one or more actions may include one or more of providing, to a user device of the passenger, a message or an automated telephone call indicating that the passenger left the item in the vehicle, or providing, to a user device of a driver of the vehicle, the message or the automated telephone call indicating that the passenger left the item in the vehicle.

Process 500 may include additional implementations, such as any single implementation or any combination of implementations described below and/or in connection with one or more other processes described elsewhere herein.

In a first implementation, the notification platform may receive, at the second time, third sensor data from another sensor associated with the vehicle, and may verify that the item is located in the vehicle at the second time based on the third sensor data.

In a second implementation, alone or in combination with the first implementation, the other sensor may include one or more of a camera located within the vehicle, a radar sensor located within the vehicle, a source sensor located within the vehicle, or a motion sensor located within the vehicle.

In a third implementation, alone or in combination with one or more of the first and second implementations, the first sensor data and the second sensor data may be received from one or more of the sensor, a vehicle control system of the vehicle, or a user device associated with a driver of the vehicle.

In a fourth implementation, alone or in combination with one or more of the first through third implementations, the vehicle may be associated with one of a ride share service or a taxicab service.

In a fifth implementation, alone or in combination with one or more of the first through fourth implementations, when receiving the first sensor data from the sensor associated with the vehicle, the notification platform may receive the first sensor data from the sensor associated with the vehicle based on the passenger starting a ride share service with the vehicle.

In a sixth implementation, alone or in combination with one or more of the first through fifth implementations, when receiving the second sensor data from the sensor associated with the vehicle, the notification platform may receive the second sensor data from the sensor associated with the vehicle based on the passenger ending a ride share service with the vehicle.

Although FIG. 5 shows example blocks of process 500, in some implementations, process 500 may include additional blocks, fewer blocks, different blocks, or differently arranged blocks than those depicted in FIG. 5. Additionally, or alternatively, two or more of the blocks of process 500 may be performed in parallel.

Figure 6:
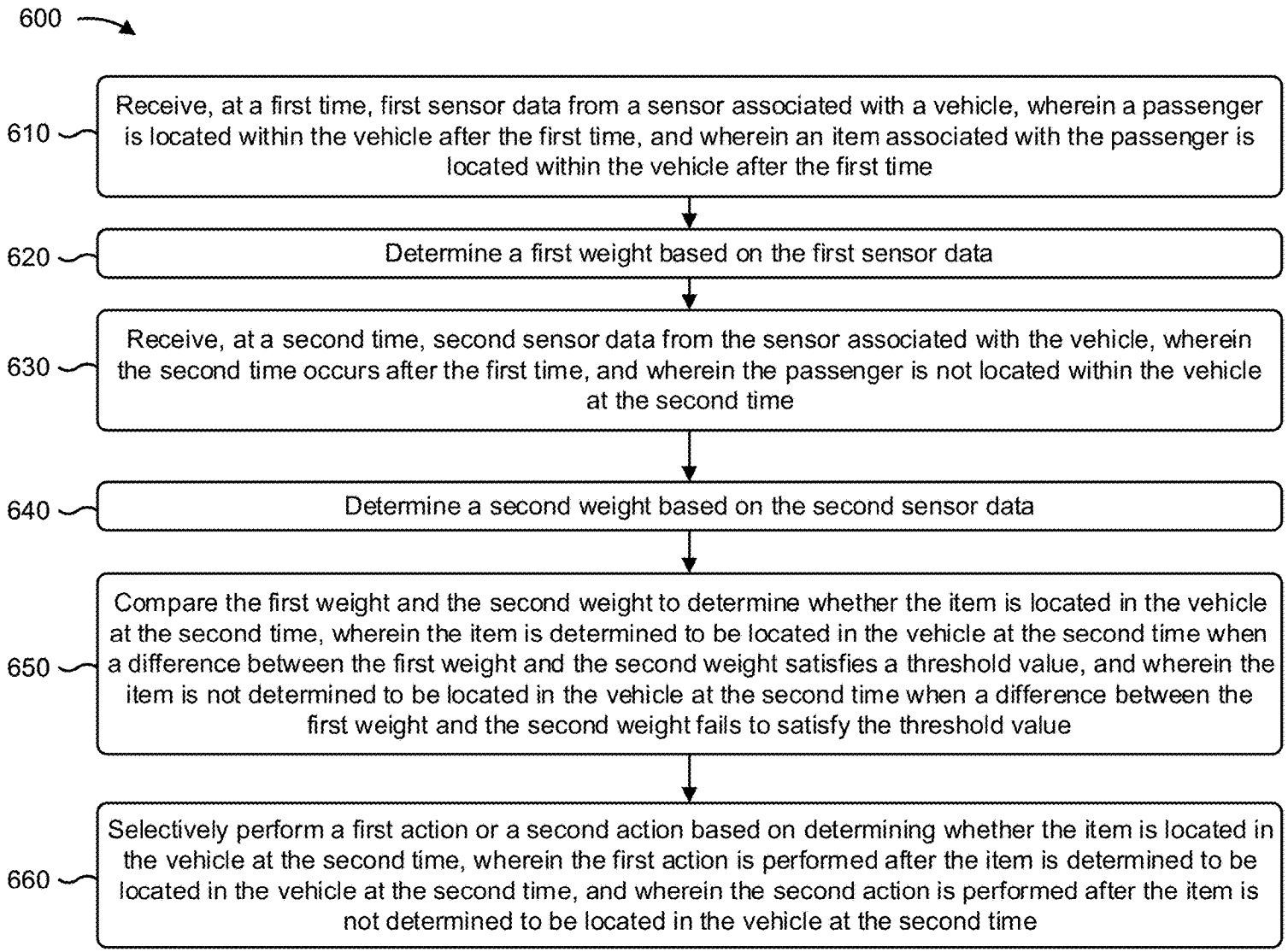

FIG. 6 is a flow chart of an example process 600 for utilizing sensor data to identify an item left in a vehicle and to perform actions based on identifying the left item. In some implementations, one or more process blocks of FIG. 6 may be performed by a notification platform (e.g., notification platform 220). In some implementations, one or more process blocks of FIG. 6 may be performed by another device or a group of devices separate from or including the notification platform, such as a user device (e.g., user device 210) and/or a server device (e.g., server device 240).

As shown in FIG. 6, process 600 may include receiving, at a first time, first sensor data from a sensor associated with a vehicle, wherein a passenger is located within the vehicle after the first time and wherein an item associated with the passenger is located within the vehicle after the first time (block 610). For example, the notification platform (e.g., using computing resource 224, processor 320, communication interface 370, and/or the like) may receive, at a first time, first sensor data from a sensor associated with a vehicle, as described above. In some implementations, a passenger is located within the vehicle after the first time. In some implementations, a passenger may be located within the vehicle after the first time and an item associated with the passenger may be located within the vehicle after the first time.

As further shown in FIG. 6, process 600 may include determining a first weight based on the first sensor data (block 620). For example, the notification platform (e.g., using computing resource 224, processor 320, memory 330, and/or the like) may determine a first weight based on the first sensor data, as described above.

As further shown in FIG. 6, process 600 may include receiving, at a second time, second sensor data from the sensor associated with the vehicle, wherein the second time occurs after the first time and wherein the passenger is not located within the vehicle at the second time (block 630). For example, the notification platform (e.g., using computing resource 224, processor 320, communication interface 370, and/or the like) may receive, at a second time, second sensor data from the sensor associated with the vehicle, as described above. In some implementations, the second time may occur after the first time and the passenger may not be located within the vehicle at the second time.

As further shown in FIG. 6, process 600 may include determining a second weight based on the second sensor data (block 640). For example, the notification platform (e.g., using computing resource 224, processor 320, storage component 340, and/or the like) may determine a second weight based on the second sensor data, as described above.

As further shown in FIG. 6, process 600 may include comparing the first weight and the second weight to determine whether the item is located in the vehicle at the second time, wherein the item is determined to be located in the vehicle at the second time when a difference between the first weight and the second weight satisfies a threshold value and wherein the item is not determined to be located in the vehicle at the second time when a difference between the first weight and the second weight fails to satisfy the threshold value (block 650). For example, the notification platform (e.g., using computing resource 224, processor 320, memory 330, and/or the like) may compare the first weight and the second weight to determine whether the item is located in the vehicle at the second time, as described above. In some implementations, the item may be determined to be located in the vehicle at the second time when a difference between the first weight and the second weight satisfies a threshold value and the item may not be determined to be located in the vehicle at the second time when a difference between the first weight and the second weight fails to satisfy the threshold value.

As further shown in FIG. 6, process 600 may include selectively perform a first action or a second action based on determining whether the item is located in the vehicle at the second time, wherein the first action is performed after the item is determined to be located in the vehicle at the second time and wherein the second action is performed after the item is not determined to be located in the vehicle at the second time (block 660). For example, the notification platform (e.g., using computing resource 224, processor 320, memory 330, storage component 340, communication interface 370, and/or the like) may selectively perform a first action or a second action based on determining whether the item is located in the vehicle at the second time, as described above. In some implementations, the first action may be performed after the item is determined to be located in the vehicle at the second time and the second action may not be performed after the item is not determined to be located in the vehicle at the second time.

Process 600 may include additional implementations, such as any single implementation or any combination of implementations described below and/or in connection with one or more other processes described elsewhere herein.

In a first implementation, the first action may include one or more of providing, to a user device of the passenger, a message indicating that the passenger left the item in the vehicle; providing, to a user device of a driver of the vehicle, the message indicating that the passenger left the item in the vehicle; providing, to the user device of the passenger, an automated telephone call indicating that the passenger left the item in the vehicle; providing, to the user device of the driver, the automated telephone call indicating that the passenger left the item in the vehicle; or charging the passenger an extra fee for the weight of the item based on increased fuel consumption caused by the weight of the item.

In a second implementation, alone or in combination with the first implementation, the second action may include one or more of triggering a ride share service to bill the passenger, or triggering a taxicab service to bill the passenger.

In a third implementation, alone or in combination with one or more of the first and second implementations, the notification platform may receive, prior to the passenger entering the vehicle, information indicating a weight of an extra item located in the vehicle, and may adjust a baseline for the first sensor data and the second sensor data based on the weight of the extra item.

In a fourth implementation, alone or in combination with one or more of the first through third implementations, the notification platform may receive, at the second time, third sensor data from another sensor associated with the vehicle, and may verify whether or not the item is located in the vehicle at the second time based on the third sensor data.

In a fifth implementation, alone or in combination with one or more of the first through fourth implementations, when receiving the first sensor data from the sensor associated with the vehicle, the notification platform may receive the first sensor data from the sensor associated with the vehicle based on the passenger starting a ride share service with the vehicle.

Although FIG. 6 shows example blocks of process 600, in some implementations, process 600 may include additional blocks, fewer blocks, different blocks, or differently arranged blocks than those depicted in FIG. 6. Additionally, or alternatively, two or more of the blocks of process 600 may be performed in parallel.

The foregoing disclosure provides illustration and description, but is not intended to be exhaustive or to limit the implementations to the precise forms disclosed. Modifications and variations may be made in light of the above disclosure or may be acquired from practice of the implementations.

As used herein, the term "component" is intended to be broadly construed as hardware, firmware, and/or a combination of hardware and software.

It will be apparent that systems and/or methods, described herein, may be implemented in different forms of hardware, firmware, or a combination of hardware and software. The actual specialized control hardware or software code used to implement these systems and/or methods is not limiting of the implementations. Thus, the operation and behavior of the systems and/or methods were described herein without reference to specific software code—it being understood that software and hardware may be designed to implement the systems and/or methods based on the description herein.

Even though particular combinations of features are recited in the claims and/or disclosed in the specification, these combinations are not intended to limit the disclosure of various implementations. In fact, many of these features may be combined in ways not specifically recited in the claims and/or disclosed in the specification. Although each dependent claim listed below may directly depend on only one claim, the disclosure of various implementations includes each dependent claim in combination with every other claim in the claim set.

No element, act, or instruction used herein should be construed as critical or essential unless explicitly described as such. Also, as used herein, the articles "a" and "an" are intended to include one or more items, and may be used interchangeably with "one or more." Furthermore, as used herein, the term "set" is intended to include one or more items (e.g., related items, unrelated items, a combination of related and unrelated items, etc.), and may be used interchangeably with "one or more." Where only one item is intended, the term "only one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A method, comprising:

receiving, by a device and at a first time, first sensor data from a sensor associated with a vehicle, wherein a passenger is located within the vehicle after the first time, and wherein an item associated with the passenger is located within the vehicle after the first time;

determining, by the device, a first weight based on the first sensor data;

receiving, by the device and at a second time, second sensor data from the sensor associated with the vehicle, wherein the second time occurs after the first time, and wherein the passenger is not located within the vehicle at the second time;

determining, by the device, a second weight based on the second sensor data;

receiving, by the device and prior to the passenger entering the vehicle, information indicating a weight of an extra item located in the vehicle, wherein the information indicating the weight of the extra item is received from a user device associated with a driver of the vehicle;

adjusting, by the device, a baseline for the first sensor data and the second sensor data based on the weight of the extra item;

comparing, by the device, the first weight and the second weight to determine whether the item is located in the vehicle at the second time, wherein the item is determined to be located in the vehicle at the second time when a difference between the first weight and the second weight satisfies a threshold value, and wherein the item is not determined to be located in the vehicle at the second time when a difference between the first weight and the second weight fails to satisfy the threshold value; and selectively performing, by the device, one or more actions based on determining whether the item is located in the vehicle at the second time, wherein the one or more actions are performed after the item is determined to be located in the vehicle at the second time, and wherein the one or more actions are not performed after the item is not determined to be located in the vehicle at the second time.

2. The method of claim 1, wherein, after the item is determined to be located in the vehicle at the second time, performing the one or more actions comprises one or more of:

providing, to a user device of the passenger, a first message indicating that the passenger left the item in the vehicle;

providing, to a user device of a driver of the vehicle, a second message indicating that the passenger left the item in the vehicle;

providing, to the user device of the passenger, a first automated telephone call indicating that the passenger left the item in the vehicle;

providing, to the user device of the driver, a second automated telephone call indicating that the passenger left the item in the vehicle; or providing, to the driver, a haptic alert indicating that the passenger left the item in the vehicle.

3. The method of claim 1, further comprising:

triggering a ride share service to start charging the passenger based on receiving the first sensor data; and triggering the ride share service to stop charging the passenger based on receiving the second sensor data.

4. The method of claim 1, further comprising:

receiving, prior to the passenger entering the vehicle, information indicating a time period for carrying an extra item located in the vehicle, wherein the information indicating the time period for carrying the extra item is received from a user device associated with a driver of the vehicle; and adjusting a baseline for the first sensor data and the second sensor data based on the time period for carrying the extra item.

5. The method of claim 1, wherein the sensor is one of a plurality of sensors located at one or more of:

under a trunk plate of the vehicle, under one or more seats of the vehicle, or under one or more floor panels of the vehicle.

6. The method of claim 1, wherein the sensor comprises one or more of:

a piezoelectric weight sensor, a Hall effect weight sensor, or a strain gauge weight sensor.

7. The method of claim 1, wherein the vehicle is associated with one of:

a ride share service, or a taxicab service.

8. A device, comprising:

one or more memories; and one or more processors communicatively coupled to the one or more memories, configured to:

receive, at a first time, first sensor data from a sensor associated with a vehicle, wherein a passenger is located within the vehicle after the first time, and wherein an item associated with the passenger is located within the vehicle after the first time;

determine a first weight based on the first sensor data;

receive, at a second time, second sensor data from the sensor associated with the vehicle, wherein the second time occurs after the first time, and wherein the passenger is not located within the vehicle at the second time;

determine a second weight based on the second sensor data;

receive, prior to the passenger entering the vehicle, information indicating a time period for carrying an extra item located in the vehicle, wherein the information indicating the time period for carrying the extra item is received from a user device associated with a driver of the vehicle;

adjust a baseline for the first sensor data and the second sensor data based on the time period for carrying the extra item;

compare the first weight and the second weight to determine that the item is located in the vehicle at the second time, wherein the item is determined to be located in the vehicle at the second time when a difference between the first weight and the second weight satisfies a threshold value; and perform one or more actions based on determining that the item is located in the vehicle at the second time, wherein the one or more actions include one or more of:

providing, to a user device of the passenger, a message or an automated telephone call indicating that the passenger left the item in the vehicle, or providing, to a user device of a driver of the vehicle, the message or the automated telephone call indicating that the passenger left the item in the vehicle.

9. The device of claim 8, wherein the one or more processors are further configured to:

receive, at the second time, third sensor data from another sensor associated with the vehicle; and verify that the item is located in the vehicle at the second time based on the third sensor data.

10. The device of claim 9, wherein the other sensor includes one or more of:

a camera located within the vehicle, a radar sensor located within the vehicle, a source sensor located within the vehicle, or a motion sensor located within the vehicle.

11. The device of claim 8, wherein the first sensor data and the second sensor data is received from one or more of:

the sensor, a vehicle control system of the vehicle, or a user device associated with a driver of the vehicle.

12. The device of claim 8, wherein the vehicle is associated with one of:

a ride share service, or a taxicab service.

13. The device of claim 8, wherein the one or more processors, when receiving the first sensor data from the sensor associated with the vehicle, are configured to:

receive the first sensor data from the sensor associated with the vehicle based on the passenger starting a ride share service with the vehicle.

14. The device of claim 8, wherein the one or more processors, when receiving the second sensor data from the sensor associated with the vehicle, are configured to:

receive the second sensor data from the sensor associated with the vehicle based on the passenger ending a ride share service with the vehicle.

15. The device of claim 8, wherein the sensor comprises one or more of:

a piezoelectric weight sensor, a Hall effect weight sensor, or a strain gauge weight sensor.

16. The device of claim 8, wherein the sensor is one of a plurality of sensors located at one or more of:

under a trunk plate of the vehicle, under one or more seats of the vehicle, or under one or more floor panels of the vehicle.

17. A non-transitory computer-readable medium storing instructions, the instructions comprising:

one or more instructions that, when executed by one or more processors, cause the one or more processors to:

receive, at a first time, first sensor data from a sensor associated with a vehicle, wherein a passenger is located within the vehicle after the first time, and wherein an item associated with the passenger is located within the vehicle after the first time;

determine a first weight based on the first sensor data;

receive, at a second time, second sensor data from the sensor associated with the vehicle, wherein the second time occurs after the first time, and wherein the passenger is not located within the vehicle at the second time;

determine a second weight based on the second sensor data;

compare the first weight and the second weight to determine whether the item is located in the vehicle at the second time, wherein the item is determined to be located in the vehicle at the second time when a difference between the first weight and the second weight satisfies a threshold value, and wherein the item is not determined to be located in the vehicle at the second time when a difference between the first weight and the second weight fails to satisfy the threshold value; and perform an action based on determining whether the item is located in the vehicle at the second time, wherein the action is performed after the item is not determined to be located in the vehicle at the second time, and wherein the action comprises one or more of:

triggering a ride share service to bill the passenger, or triggering a taxicab service to bill the passenger.

18. The non-transitory computer-readable medium of claim 15, wherein the instructions further comprise:

one or more instructions that, when executed by the one or more processors, cause the one or more processors to:

receive, prior to the passenger entering the vehicle, information indicating a weight of an extra item located in the vehicle; and adjust a baseline for the first sensor data and the second sensor data based on the weight of the extra item.

19. The non-transitory computer-readable medium of claim 15, wherein the instructions further comprise:

one or more instructions that, when executed by the one or more processors, cause the one or more processors to:

receive, at the second time, third sensor data from another sensor associated with the vehicle; and verify whether or not the item is located in the vehicle at the second time based on the third sensor data.

20. The non-transitory computer-readable medium of claim 17, wherein the one or more instructions, that cause the one or more processors to receive the first sensor data from the sensor associated with the vehicle, further cause the one or more processors to:

receive the first sensor data from the sensor associated with the vehicle based on the passenger starting the ride share service with the vehicle.

* * * * *